US006401691B1

(12) United States Patent
Kawano et al.

(10) Patent No.: US 6,401,691 B1
(45) Date of Patent: Jun. 11, 2002

(54) FUEL SUPPLY SYSTEM FOR RELIEVING FUEL PRESSURE PULSATIONS AND DESIGNING METHOD THEREOF

(75) Inventors: Takanobu Kawano, Nishio; Tohru Yoshinaga, Okazaki; Katsuyuki Tanaka, Nishio; Kenji Kanehara, Toyohashi; Yoshihiro Nakase, Okazaki; Masaki Takeyama, Okazaki; Yoichi Sugiura, Okazaki; Katsuhiko Aoyama, Nukata-gun; Toshio Imamura, Okazaki, all of (JP)

(73) Assignees: Nippon Soken, Inc., Aichi-Pref.; Toyota Jidosha Kabushiki Kaisha, Aichi-Ken, both of (JP)

( * ) Notice: Subject to any disclaimer, the term of this patent is extended or adjusted under 35 U.S.C. 154(b) by 0 days.

(21) Appl. No.: 09/425,049

(22) Filed: Oct. 22, 1999

(30) Foreign Application Priority Data

Oct. 22, 1998 (JP) ..... 10-300809
Apr. 30, 1999 (JP) ..... 11-124904

(51) Int. Cl.[7] ..... F02M 37/04
(52) U.S. Cl. ..... 123/456; 123/467
(58) Field of Search ..... 123/198 D, 467, 123/468, 469, 447, 456

(56) References Cited

U.S. PATENT DOCUMENTS 3,810,581 A * 5/1974 Rhine et al. ..... 239/533.3
4,295,452 A * 10/1981 Lembke et al. ..... 123/470
4,526,151 A * 7/1985 Tateishi et al. ..... 123/468
4,660,524 A * 4/1987 Bertsch et al. ..... 123/468
5,447,139 A * 9/1995 Yonekawa et al. ..... 123/456
5,476,080 A * 12/1995 Brunnhofer ..... 123/468
5,577,479 A * 11/1996 Popp ..... 123/458
5,592,968 A * 1/1997 Nakashima et al. .... 137/561 A
5,752,486 A 5/1998 Nakashima et al.
5,954,031 A * 9/1999 Ogiso et al. ..... 123/447
6,189,510 B1 * 2/2001 Jaeger ..... 123/468

FOREIGN PATENT DOCUMENTS

JP 57-100693 6/1982
JP 10-73062 3/1998

* cited by examiner

*Primary Examiner*—Carl S. Miller
(74) *Attorney, Agent, or Firm*—Nixon & Vanderhye PC

(57) ABSTRACT

A damping chamber is formed in a pressure relaxation device connected to a high pressure fuel pipe. Valve bodies are provided at openings of partitions, and a spring force is applied to the valve bodies by a spring in a valve closing direction. When a high pressure portion reaches an inlet of the damping chamber, the valve body opens to hold and absorb the high pressure portion in the damping chamber. When a low pressure portion reaches the inlet of the damping chamber, the high pressure portion held in the damping chamber is gradually released via a restricted orifice to cancel the low pressure portion, thereby reducing the pressure pulsation of fuel.

14 Claims, 16 Drawing Sheets

FIG. 29A
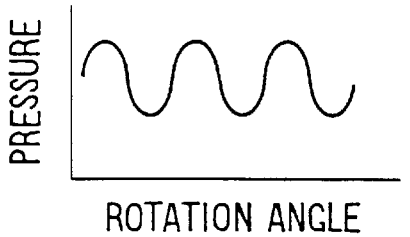
FIG. 29C
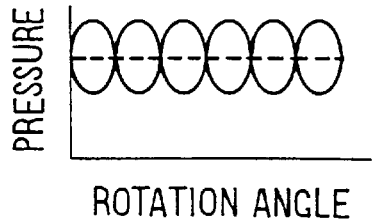
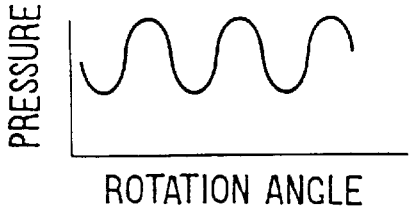
FIG. 29B
FIG. 30
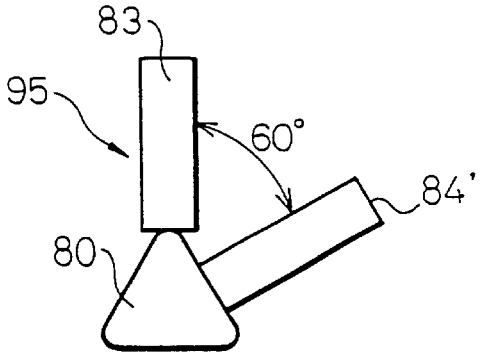
FIG. 31
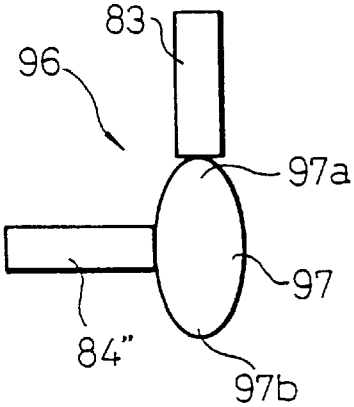

FUEL SUPPLY SYSTEM FOR RELIEVING FUEL PRESSURE PULSATIONS AND DESIGNING METHOD THEREOF

CROSS REFERENCE TO RELATED APPLICATION

This application is based upon and claims priority from Japanese patent application Nos. Hei 10-300809, filed Oct. 22, 1998 and Hei 11-124904, filed Apr. 30, 1999, the entire contents of which are incorporated herein by reference.

BACKGROUND OF THE INVENTION

1. Field of the Invention

The present invention relates to a fuel supply system which relieves fuel pressure pulsations in a fuel line of an internal combustion engine such as a direct injection engine which directly injects fuel into a cylinder.

2. Description of Related Art

According to a direct injection engine, it may inject fuel into a highly pressurized cylinder at a compression stroke. Therefore, pressure of fuel supplied to an injector is set higher than that of a conventional engine which injects fuel into an intake port having a low pressure.

The fuel is intermittently discharged to a common high pressure fuel pipe at a fuel discharge pump, such as a fuel injection pump, by a plunger which is driven by a cam to reciprocate. Accordingly, high pressure pulsation is generated in fuel in the high pressure fuel pipe according to the shape of the cam. In addition, the pressure in the high pressure fuel pipe is temporarily reduced because each one of a plurality of injectors connected to the common high pressure fuel pipe intermittently opens its valve respectively to inject fuel. As a result, pressure pulsations having high pressure and low pressure are generated in fuel flowing in the high pressure fuel pipe, and proceed in the high pressure fuel pipe as pressure waves.

Accordingly, whether the pressure pulsation having high pressure or the pressure pulsation having low pressure is at a fuel supply port of an injector when the injector opens its valve changes fuel injection quantity even if the injector opens its valve at the same timing.

Such injection quantity fluctuation caused by the pressure pulsation in the high pressure fuel pipe is also generated on the conventional engine which injects fuel into the intake port as long as a plurality of injectors are connected to a common fuel pipe to receive fuel. In order to solve this problem, JP-U-57-100,693 discloses a pressure relaxation device, that is a pressure damper.

However, an injection pressure of the injector and a fuel pressure in the fuel line for the direct injection engine are higher than those for the conventional engine. Therefore, such injection quantity fluctuation for each one of the injectors for the direct injection engine may be greater.

If a conventional pressure damper comprising a soft damping member, such as a diaphragm or a bellows, is applied to a high pressure fuel pipe of the direct injection engine, the damping member may be easily broken because the fuel pressure in the high pressure fuel pipe of the direct injection engine is high. In that case, sufficient durability and reliability can not be obtained. If a full accumulator is employed in order to relieve the pressure in the high pressure fuel pipe of the direct injection engine, the whole apparatus is increased in size and cost because the accumulator itself is large and expensive.

According to a V-type engine, single fuel line is separated into two pipes toward two banks and joined together at their ends to form a loop. According to such loop-shaped fuel line, a crests or troughs of the pressure waves progressing in the respective separated fuel pipes may meet at the joint of the pipes. In that case, the pressure pulsation is magnified by summating respective crests or respective troughs, and a big pressure wave progresses in the fuel line in a reversed direction.

Furthermore, the pressure pulsation is magnified by resonance when a pressure pulsation frequency approaches a natural frequency of the fuel line.

Such magnified pressure pulsations may cause further fluctuation of the injection quantity.

JP-A-10-73,062 discloses an apparatus which absorbs the vibration by a resonator. However, the resonator makes the structure complicated and expensive. Furthermore, the pressure pulsation in a wide range of the frequency can not be prevented by absorbing pressure pulsation in a certain range of the frequency because the engine rotation speed always varies and the generated pressure pulsation and frequency also vary.

Further, JP-A-9-170514 discloses an accumulator injection apparatus for a diesel engine having a common-rail for cylinders at a part of a fuel passage connecting a high pressure supply pump and fuel injection valves for respective cylinders, and having an orifice at an inlet or outlet of the common-rail to prevent the fuel pressure pulsation. However, if such apparatus is applied to a direct injection engine using gasoline, vapors are prone to remain in the fuel because the diameter of the orifice is very small. As a result, it is difficult to supply small amount of fuel precisely according to the reducing injection quantity during the lean burn. Furthermore, the small diameter of the orifice may be clogged by a foreign object.

SUMMARY OF THE INVENTION

The present invention is made in light of the foregoing problem, and it is an object of the present invention to provide a fuel supply system which reduces pressure pulsation in a high pressure fuel pipe and which has high durability and reliability.

According to an aspect of the present invention, when a high pressure portion of a pressure wave in a high pressure pipe reaches an inlet of a damping chamber formed in a pressure relaxation device, a valve provided at the inlet of the damping chamber opens to receive and hold the high pressure portion in the damping chamber.

Accordingly, the pressure around the inlet is reduced, and a reflection of the high pressure portion in a reverse direction is prevented.

Then, when a low pressure portion of the pressure wave reaches the inlet of the damping chamber, the high pressure portion held in the damping chamber is gradually released via a restricted orifice. Accordingly, the pressure of the low pressure portion increases, and a reflection of the low pressure portion in a reverse direction is prevented.

Thus, the pressure pulsation generated in fuel in the high pressure pipe is reduced, and an injection quantity for a valve opening unit time of the injector becomes constant. Accordingly, it becomes possible to reduce a fluctuation of the injection quantity even if the engine speed is changed.

Furthermore, the pressure relaxation device includes the damping chamber, the valve for opening/closing the inlet of the damping chamber, an elastic member for applying a spring force to the valve, and the restricted orifice which bypasses the valve. Accordingly, a breakage is prevented even if the fuel pressure is high in the high pressure pipe, and high reliability is obtained because of a high durability of the system.

Furthermore, the pressure relaxation device may be formed as an extended high pressure pipe, thereby facilitating to reduce its size. Therefore, the fuel supply system or the engine itself is not increased in size by providing the pressure relaxation device.

According to another aspect of the present invention, the restricted orifice is formed in the valve. Accordingly, manufacturing the restricted orifice is facilitated.

According to another aspect of the present invention, the restricted orifice is formed as a gap between a valve body and a valve seat by a spacer which prevents a fully closed state. Accordingly, it is not necessary to bore a hole.

According to another aspect of the present invention, the restricted orifice is formed in the valve seat on which the valve body abuts.

According to another aspect of the present invention, when a high pressure portion of a pressure wave transmitted in the fuel in the high pressure fuel pipe reaches an inlet of a damping chamber formed in a pressure relaxation device, a flexible bag enclosing a high pressure gas is slightly deformed to absorb the high pressure portion of the pressure wave. Further, when a low pressure portion reaches the inlet of the damping chamber, the flexible bag returns to its original shape to increase the pressure of the low pressure portion, thereby reducing the pressure pulsation of the fuel in the high pressure pipe.

Accordingly, a fluctuation of an injection quantity of the injector is prevented. Since the pressure relaxation device is like an extended high pressure pipe, it is easy to reduce it in size. Thus, the fuel supply system or the engine will not be increased in size by providing the pressure relaxation device.

According to another aspect of the present invention, the bag for absorbing the pressure pulsation is made of a rubber reinforced with a fiber which is slightly extendable. Thus, it has a very strong structure.

According to another aspect of the present invention, the bag is filled with inert gas. Accordingly, deterioration of the bag caused by a gas is prevented.

According to another aspect of the present invention, it is suitable for a multi-cylinder V-type engine because the high pressure pipe is formed in the shape of a loop.

According to another aspect of the present invention, it is suitable for a multi-cylinder in-line engine because the high pressure fuel pipe has a first end and a second end. However, it may be applicable to a multi-cylinder V-type engine if the high pressure fuel pipe is bent.

According to another aspect of the present invention, a method of designing a fuel supply system for an internal combustion engine which reduces the pressure pulsation of fuel includes a step of calculating a resonance frequency corresponding to a predetermined design data of the system, and includes a step of changing the design data such that the calculated resonance frequency exceeds a target frequency determined based on an order frequency of harmonics which may cause the resonance, and includes a step of calculating a waveform of the pressure pulsation by a numerical analysis, and includes a step of determining an order frequency of the harmonics, whose resonance should be prevented, from a peak if an amplitude of the calculated waveform, and includes a step of calculating a magnitude of a pulsation pressure, and includes a step of changing design data of the system such that the pulsation pressure is less than a predetermined target value.

Accordingly, the occurrence of the resonance is completely prevented without overlooking any order frequency.

According to another aspect of the present invention, a pair of protruded portions having an inner diameter greater than an inner diameter of a connecting pipe are formed on a pair of delivery pipes opposite to each other, and the delivery pipes are connected by attaching a connecting pipe to the protruded portions.

Accordingly, an average inner diameter of a connecting portion is greater than that of the connecting pipe, and the protruded portions are formed opposite to each other. Thus, the length of the connecting pipe is shortened by the length of the protruded portions. Accordingly, the resonance frequency (natural frequency) of the system is shifted to higher side, and a possibility of the conformity with a discharge pulsation of a fuel pump or with its harmonics is reduced. Therefore, a pressure pulsation increase of the high pressure fuel flowing in the fuel pipe caused by the resonance is prevented, and an injection quantity fluctuation of each injector is prevented.

According to another aspect of the present invention, an enlarged volume portion whose inner diameter is enlarged is provided on a connecting pipe connecting delivery pipes. Accordingly, an average inner diameter of the connecting pipe is increased, and the resonance frequency of the system shifts to the higher side. Thus, the resonance caused by the conformity with the pressure pulsation or the frequency of its harmonics is prevented.

According to another aspect of the present invention, a part of a connecting pipe connecting delivery pipes is made of a flexible material. Thus, the connecting pipe is bent with smaller force, and thereby facilitating the assembly of the fuel supply system. Furthermore, the flexible material absorbs and reduces the pressure pulsation of the high pressure fuel by its elastic deformation, and the flexible material prevents a possible damage of the connecting pipe caused by vibration fatigue for a rigid body.

According to another aspect of the present invention, a pair of delivery pipes corresponding to a pair of banks are connected in series by a connecting pipe, one of the delivery pipes having a volume that is greater than a volume of the other of the delivery pipes, such that widths of respective pressure pulsations in the delivery pipes are substantially equal. Accordingly, fuel injection quantity fluctuation between the cylinders of the respective banks, caused by a difference between the pulsation widths of the pressure pulsations, is prevented.

According to another aspect of the present invention, an inside of a pair of delivery pipes is divided into a plurality of groups. Accordingly, the resonance frequency of the entire system shifts to the higher side because the resonance frequencies (natural frequency) in respective groups are increased. Thus, a possibility of an occurrence of the resonance with the pressure pulsation of the discharge pulsation and the like or its harmonics is reduced. Since the divided groups communicate with an adjacent one of the divided groups via a narrow passage, the flow of the high pressure fuel among the divided groups is not prevented.

According to another aspect of the present invention, a connecting pipe having a relatively large diameter is unified with a delivery pipe. Accordingly, an impedance of a connecting portion and an impedance of the entire system are reduced, and the resonance frequency (natural frequency) of the system extremely shifts to the higher side. Thus, a possibility of the synchronization with the pressure pulsation or frequency of its harmonics is reduced, and the resonance under the normal driving condition of the engine is prevented.

According to another aspect of the present invention, at least one pair of delivery pipes adjacent each other are connected via a flexible member on their substantially entire surfaces opposing each other. Accordingly, impedance of the delivery pipes is decreased.

According to another aspect of the present invention, a directional restricted orifice is provided on at least a part of a connecting pipe as a high pressure pipe connected to an injector. The flow resistance at the restricted orifice is decreased when pressurized fuel flows from a fuel pump toward the injector, but it is increased when pressurized fuel flows in an opposite direction. Thus, when a pressure wave, generated by a discharge pulsation of the fuel pump or opening/closing of the injector, progresses in the high pressure pipe in the opposite direction, the restricted orifice reduces its opening area to prevent the pressure wave progress. Accordingly, an amplitude increase caused by superposition or resonance of the pressure waves is prevented.

According to another aspect of the present invention, the directional restricted orifice includes a conical elastic body having a flexible opening on a tip of the conical elastic body.

According to another aspect of the present invention, a fuel pump includes a plurality of plungers slidably inserted in respective cylinders, a common cam for reciprocating the plungers, a plurality of pressure chambers formed by the cylinders and the plungers, and a common discharge chamber for mixing pressurized fuel discharged from the pressure chambers. Relative angle positions of the respective cylinders are determined such that pressure pulsations of the pressurized fuel generated in the respective pressure chambers are canceled each other in the common discharge chamber.

Accordingly, discharge pulsation is not substantially included in pressurized fuel discharged from the common discharge chamber. Thus, a fuel injection quantity fluctuation of the injectors for respective cylinders and a vibration occurrence are prevented.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

FIGS. 29A to 29C are graphs showing a relation between a rotation angle and pressure to explain an operation according to the eighteenth embodiment of the present invention;

FIG. 30 is a schematic illustration showing a main part of a pressure feed type fuel pump according to a nineteenth embodiment of the present invention; and FIG. 31 is a schematic illustration showing a main part of a pressure feed type fuel pump according to a twentieth embodiment of the present invention.

DETAILED DESCRIPTION OF PREFERRED EMBODIMENTS

Embodiments of the present invention will be described hereinafter with reference to the drawings.

(First Embodiment)

Figure 1:
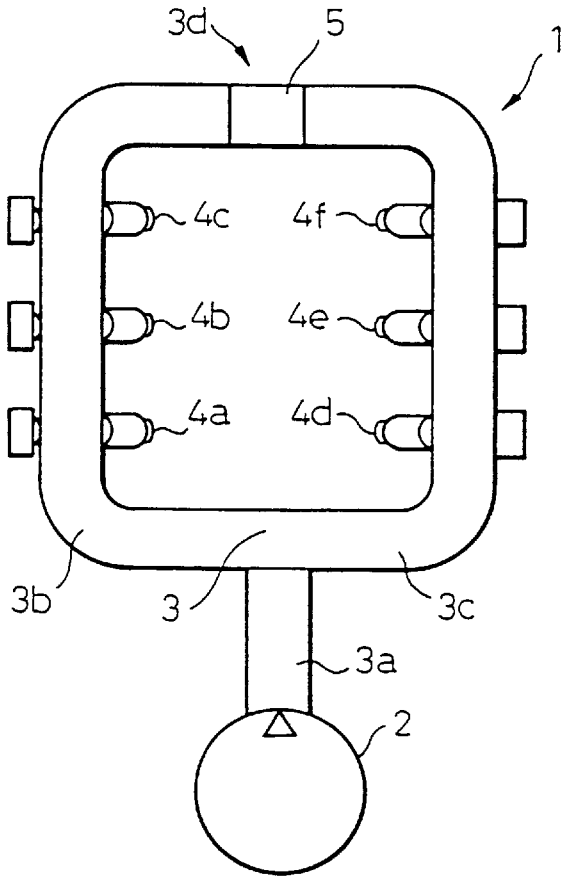
FIG. 1 is a schematic illustration showing a plan view of an entire structure of a fuel supply apparatus according to a first embodiment of the present invention.

A total structure of a fuel supply system 1 as a first embodiment of the present invention is shown in FIG. 1. The fuel supply system 1 is applicable to a six cylinder V-type engine, and includes a pressure feed type fuel pump 2 for pressurizing fuel for injection, a high pressure fuel pipe 3 and six injectors 4*a* to 4*f* for injecting fuel to respective six cylinders not shown.

The high pressure fuel pipe 3 includes a base 3*a* for connecting the fuel pump 2, branch portions 3*b* and 3*c* which diverge to a left bank and a right bank of the V-type engine respectively, and a joint portion 3*d* for connecting the branch portions 3*b* and 3*c* at their ends. The branch portions 3*b* and 3*c* and the joint portion 3*d* form a loop.

The left branch 3*b* has three injectors 4*a* to 4*c* for three cylinders which belong to the left bank. The right branch 3*c* has three injectors 4*d* to 4*f* for three cylinders which belong to the right bank.

Figure 2:
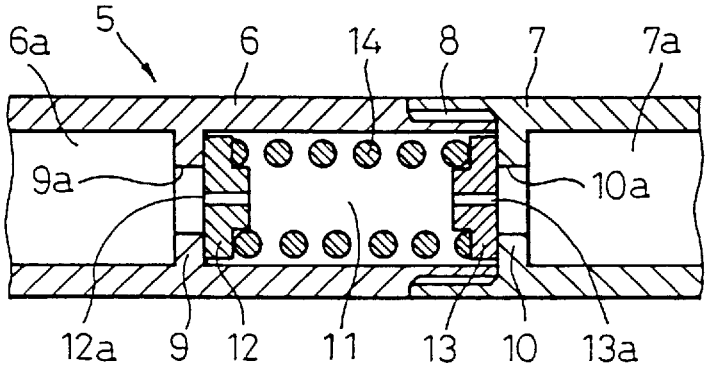
FIG. 2 is a longitudinal sectional view showing a pressure relaxation device according to the first embodiment of the present invention.

A pressure relaxation device 5 shown in FIG. 2 is provided at the joint portion 3*d* to absorb the pressure pulsation, and thereby reducing the fluctuation of the injection quantity at the injectors 4*a* to 4*f*.

Detailed structure of the pressure relaxation device 5 shown in FIG. 2 will now be described.

The end portions of the left branch 3*b* and the right branch 3*c* respectively correspond to a left pipe 6 and a right pipe 7 which form the joint portion 3*d*. The left and right pipes 6 and 7 may be a pipe connected to the end portions of the left branch 3*b* and the right branch 3*c* instead.

The left pipe 6 and the right pipe 7 are connected each other by a screwed portion 8. Partitions 9 and 10 are formed in the left pipe 6 and the right pipe 7 respectively to form a damping chamber 11.

The partitions 9 and 10 have openings 9*a* and 10*a* respectively. Disk valves 12 and 13 for closing and opening respective openings 9*a* and 10*a* are always biased toward the partitions 9 and 10 respectively by a spring 14 located between the disk valves 12 and 13. Accordingly, inner surfaces of the partitions 9 and 10 become valve seats for the disk valves 12 and 13 respectively.

Orifices 12*a* and 13*a* significantly smaller than the openings 9*a* and 10*a* are formed in the disk valves 12 and 13 respectively. Accordingly, inner space 6*a* of the left pipe 6 and inner space 7*a* of the right pipe 7 are always communicated with the damping chamber 11 via the orifices 12*a* and 13*a* even if the disk valves 12 and 13 are closed. The disk valves 12 and 13 have respective protrusions to ensure the engagement between both ends of the spring 14 and the disk valves 12 and 13.

High pressurized fuel pressurized by the fuel pump 2 is separated to the left branch 3*b* and the right branch 3*c* from the base 3*a*, and is injected directly to the cylinders as a fuel spray when the respective injectors 4*a* to 4*f* for the left and right banks of the six cylinder V-type engine open their valves.

Figure 3A:
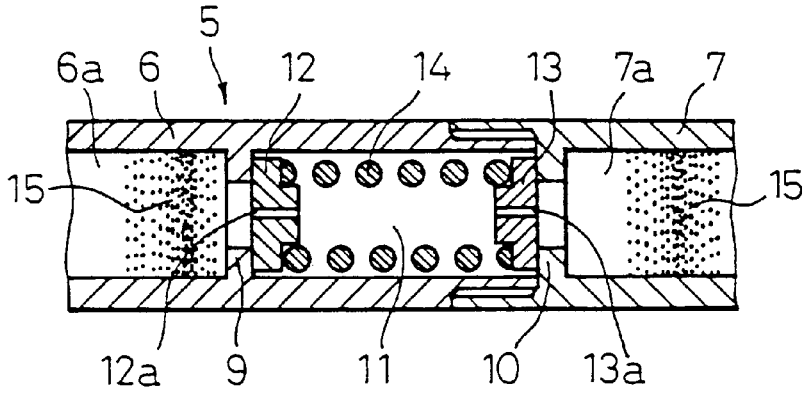
FIGS. 3A to 3D are longitudinal sectional views showing operations of the pressure relaxation device according to the first embodiment of the present invention.

When the fuel is pressurized by a plunger (not shown) of the fuel pump 2 and discharged to the base 3*a* of the high pressure fuel pipe 3, the plunger reciprocates and the pressure pulsations are generated. High pressure portions 15 of fuel are intermittently generated and are transmitted as pressure waves from the base 3*a* to the left and right branches 3*b* and 3*c* in a fuel flowing direction, and reach the pressure relaxation device 5 from both sides as shown in FIG. 3A.

Figure 3B:
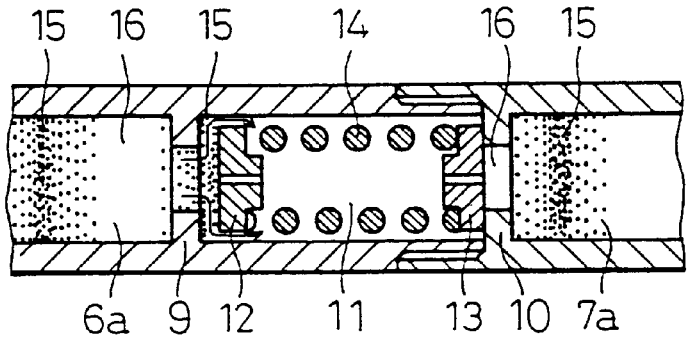

The valves 12 and 13 usually close the openings of the partitions 9 and 10 respectively. Only when the high pressure portions 15 reaches the inner space 6*a* or 7*a* in front of the valve 12 or 13, for example, the valve 12 opens against the spring force of the spring 14 as shown in FIG. 3B. Accordingly, the high pressure portion 15 of the fuel enters the damping chamber 11.

Figure 3C:
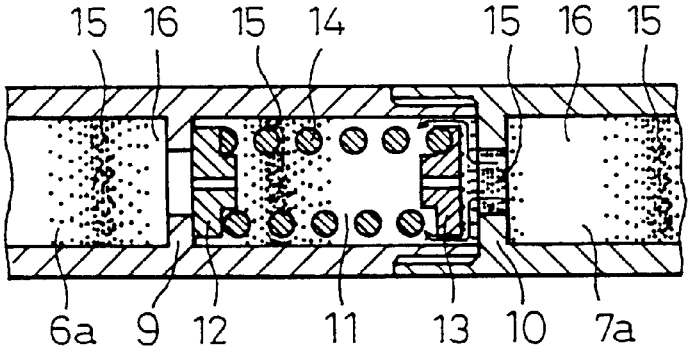

When the fuel pressure in the inner space 6*a* decreases thereafter, the valve 12 closes as shown in FIG. 3C to hold the high pressure portion 15 in the damping chamber 11. Under this situation, another high pressure portion 15 reached the right valve 13 to open it, and the high pressure portion 15 in the inner space 7*a* is about to enter the damping chamber 11.

Figure 3D:
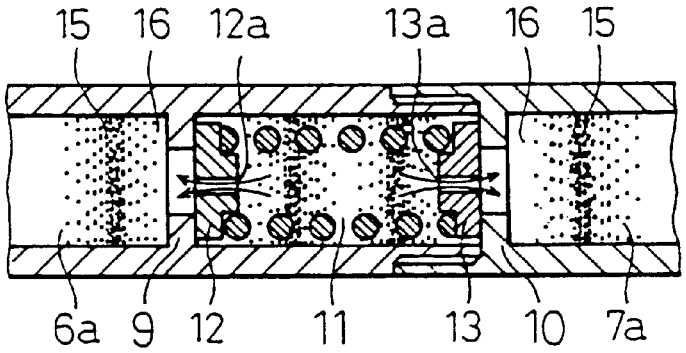

The trapped high pressure portion 15 in the damping chamber 11 is gradually released to the inner space 6*a* or 7*a* via the orifice 12*a* or 13*a* as shown in FIG. 3D when a low pressure portion of the pressure wave reaches the inner space 6*a* or 7*a*, that is when the fuel pressure in the inner space 6*a* or 7*a* is decreased. Accordingly, the fuel pressure of the low pressure portion in the inner space 6*a* and 7*a* increases, and the fuel pressure of the high pressure portion in the damping chamber 11 gradually decreases.

As a result, reflections of the high pressure portion and the low pressure portion at the partition 9 or 10 and transmissions thereof in a direction opposite to the fuel flow direction are prevented.

Furthermore, an increase of the pressure pulsation transmitting in the high pressure fuel pipe 3 caused by the oscillation is prevented by the pressure relaxation device 5.

Accordingly, when the pressure relaxation device 5 is provided at the joint portion 3*d* even for the fuel supply system 1 having the loop shape frequently applied to the six cylinder V-type engine, a collision between the high pressure portion and the low pressure portion at the joint portion 3*d* is prevented. Thus, the fuel pressure pulsation is effectively prevented, and an injection quantity fluctuation of the injector 4 is prevented.

(Second Embodiment)

Figure 4:
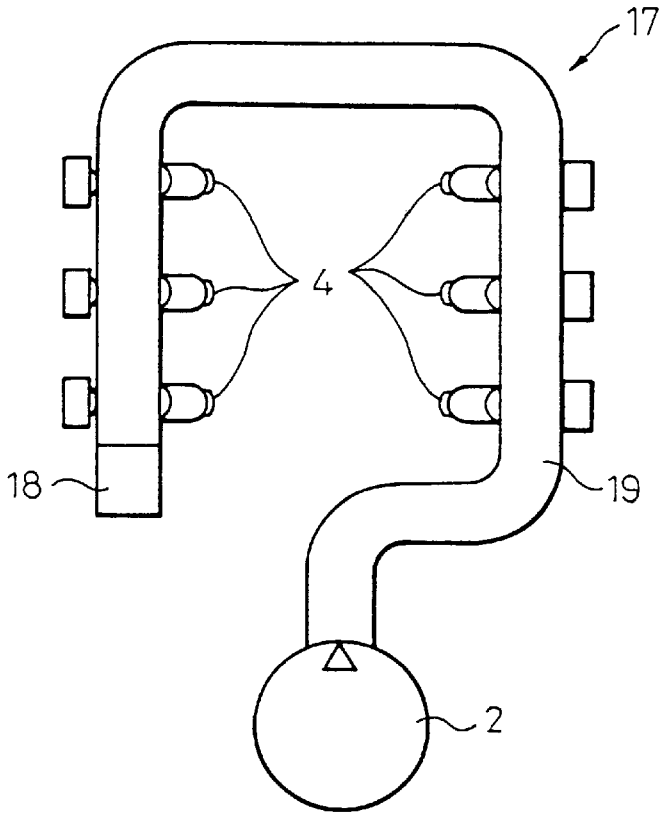
FIG. 4 is a schematic illustration showing a plan view of an entire structure of a fuel supply apparatus according to a second embodiment of the present invention.

A total structure of a fuel supply system 17 as a second embodiment of the present invention is shown in FIG. 4.

In this and the following embodiments, parts and components which are substantially the same as those in previous embodiments are assigned the same reference numerals.

In the second embodiment, the fuel supply system 17 is applied to a six cylinder V-type engine having six injectors 4 on a single high pressure fuel pipe 19 as shown in FIG. 4. Pressure feed type fuel pump 2 is attached to one end of the high pressure fuel pipe 19, and a pressure relaxation device 18 is attached to the other end of the high pressure fuel pipe 19. If the high pressure fuel pipe 19 is modified to a straight line, the present invention is also applicable to a six cylinder in-line engine.

Figure 5:
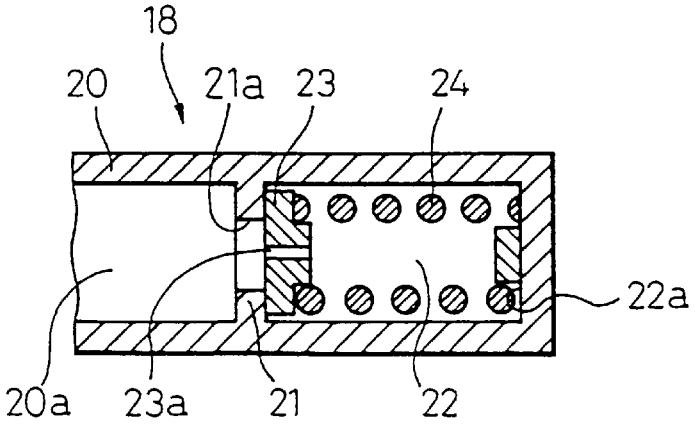
FIG. 5 is a longitudinal sectional view showing a pressure relaxation device according to the second embodiment of the present invention.

The pressure relaxation device 18 will now be described referring to FIG. 5. Pipe portion 20 of the pressure relaxation device 18 is connected to a tip of the high pressure fuel pipe 19, but it may be a part of the tip of the high pressure fuel pipe 19 instead. Inner space 20*a* of the pipe portion 20 is separated from a damping chamber 22 by a partition 21.

An opening 21*a* is formed in the partition 21, and a valve body 23 is provided for closing and opening the opening 21*a*. A small orifice 23*a* if formed in the valve body 23.

The valve body 23 is always biased toward the partition 21 by a spring 24. One end of the spring 24 is supported by a bottom surface 22*a* of the damping chamber 22.

Operations of the fuel supply system 17 according to the second embodiment is similar to those in the first embodiment.

In other words, pressurized fuel pressurized by the fuel pump 2 has the pressure pulsation since it has been discharged, and the pressure pulsation is further increased by opening valves of the injectors 4. Since the pressure wave is transmitted in the high pressure fuel pipe 19 from the end to the tip, high pressure portion and low pressure portion reach the inner space 20*a* in turn.

If the pressure relaxation device 18 is not provided at the tip of the high pressure fuel pipe 19, the pressure wave is reflected at the tip of the high pressure fuel pipe 19 and is transmitted in a reversed direction. Accordingly, the pressure pulsation is increased when the phase of the pressure wave transmitted in one direction and the phase of the pressure wave transmitted in the opposite direction are synchronized, and the injection quantities of the respective injectors 4 fluctuate significantly.

According to the second embodiment, however, the pressure relaxation device 18 is provided at the tip of the high pressure fuel pipe 19. When the high pressure portion of the pressure wave reaches the inner space 20*a,* the valve 23 opens its valve to trap the high pressure portion in the damping chamber 22.

Then, when the low pressure portion reaches the inner space 20*a,* the high pressure portion (highly pressurized fuel) gradually flows out from the damping chamber 22 via the orifice 23*a* of the valve body 23. Accordingly, pressure of the low pressure portion is increased, and the pressure pulsation is reduced. Thus, the fluctuation of the injection quantity of the injectors 4 is reduced.

(Third Embodiment)

Figure 6:
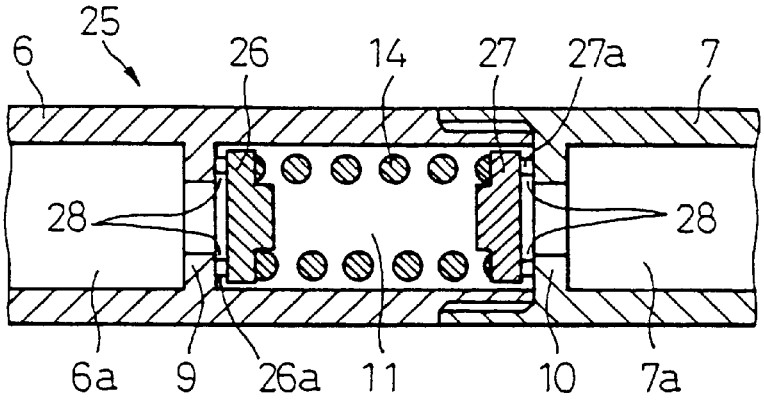
FIG. 6 is a longitudinal sectional view showing a pressure relaxation device according to a third embodiment of the present invention.

FIG. 6 shows a pressure relaxation device 25 as a main part in a third embodiment of the present invention. Differences between the pressure relaxation device 5 in the first embodiment shown in FIG. 2 and the pressure relaxation device 25 in the third embodiment are that valve bodies 26 and 27 of the pressure relaxation device 25 do not have an orifice and that protrusions 26*a* and 27*a* are provided such that a small gap 28 is maintained even if the valve bodies 26 and 27 seat on the partitions 9 and 10.

According to the third embodiment, the gap 28 functions as the orifices 12*a* and 13*a* in the first embodiment. Thus, the pressure relaxation device 25 operates in substantially the same way as the pressure relaxation device 5 in the first embodiment. By releasing the high pressure portion of the fuel trapped in the damping chamber 11 gradually, the same effect as the first embodiment is obtained.

The protrusions 26*a* and 27*a* may be spacers which allow the fuel to pass through. Such spacers may be provided in the inner space 6*a* and 7*a* instead.

(Fourth Embodiment)

Figure 7:
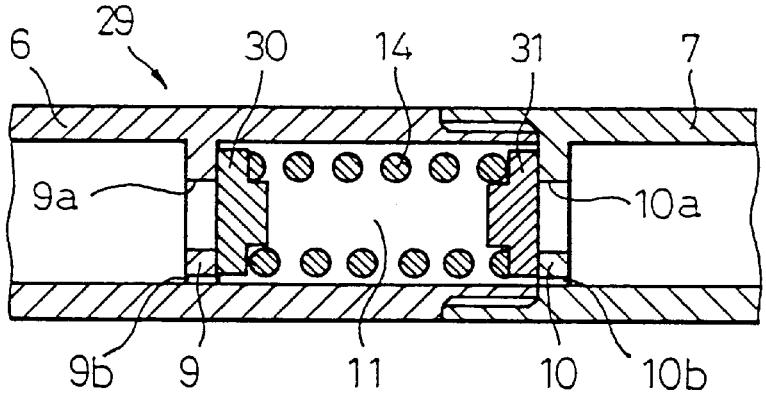
FIG. 7 is a longitudinal sectional view showing a pressure relaxation device according to a fourth embodiment of the present invention.

FIG. 7 shows a pressure relaxation device 29 as a main part in a fourth embodiment of the present invention. Differences between the pressure relaxation device 5 in the first embodiment shown in FIG. 2 and the pressure relaxation device 29 in the fourth embodiment are that valve bodies 30 and 31 of the pressure relaxation device 29 do not have an orifice and that small orifices 9*b* and 10*b* are formed in the partitions 9 and 10 such that the damping chamber 11 and the inner space 6*a* or 7*a* are communicated each other even if the openings 9*a* and 10*a* are closed by the valve bodies 30 and 31.

According to the fourth embodiment, the same effect and advantage are obtained.

(Fifth Embodiment)

Figure 8:
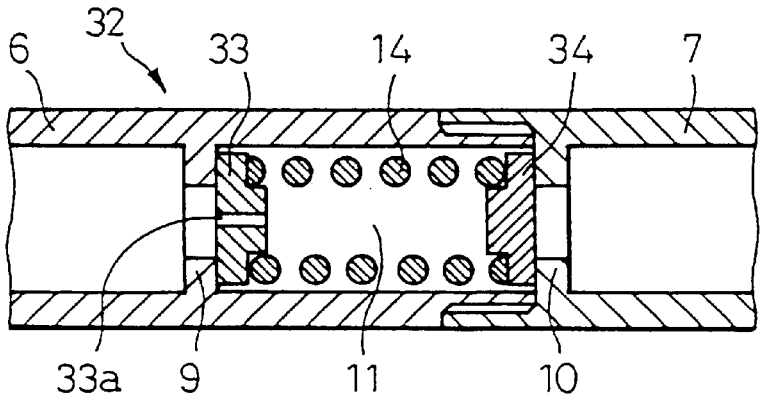
FIG. 8 is a longitudinal sectional view showing a pressure relaxation device according to a fifth embodiment of the present invention.

FIG. 8 shows a pressure relaxation device 32 as a main part in a fifth embodiment of the present invention. A difference between the pressure relaxation device 5 in the first embodiment shown in FIG. 2 and the pressure relaxation device 32 in the fifth embodiment is that a valve body 34 does not have an orifice while a valve body 33 has an orifice 33*a*.

Since the entire structures in the third to the fifth embodiments are substantially the same as the one shown in FIG. 1, the high pressure fuel pipe 3 has a loop shape. Therefore, the orifice to relieve the high pressure portion of the fuel trapped in the damping chamber 11 gradually is not necessarily provided at both partitions 9 and 10. Therefore, substantially the same result is obtained by providing the single orifice 33*a* comparing with providing two orifices.

From the same reason, substantially the same result is obtained even if the two orifices or the two gaps are reduced to single orifice or gap.

(Sixth Embodiment)

Figure 9A:
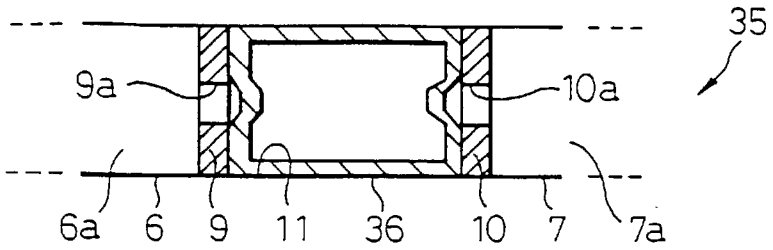
FIGS. 9A to 9C are longitudinal sectional views showing operations of the pressure relaxation device according to a sixth embodiment of the present invention.
Figure 9B:
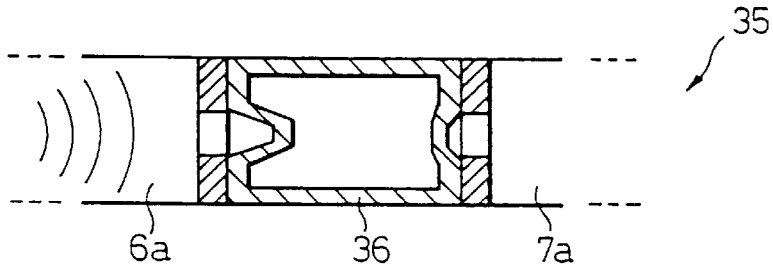
Figure 9C:
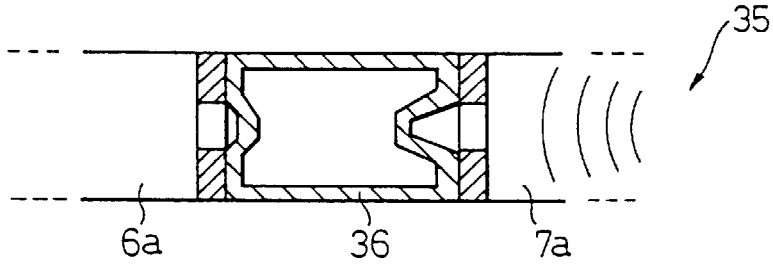

FIGS. 9A to 9C show a structure and an operation of the pressure relaxation device 35 as a main part of a six embodiment of the present invention.

The pressure relaxation device 35 is also applied to a loop-shaped fuel supply system 1 shown in FIG. 1, and is provided at the joint portion 3*d*.

A characteristic of the sixth embodiment is to insert a bag 36 made of a tough material which is a little flexible but is little extendable into the damping chamber 11 between the partitions 9 and 10 without providing the valve bodies and springs shown in the previous embodiments.

For example, the bag 36 is made by coating a rubber layer having a certain thickness on a bag made of woven material, such as Kevler fiber. In this case, the rubber is a synthetic rubber which is hard to be deteriorated by the fuel. High pressure inert gas, such as gaseous nitrogen which does not deteriorate the rubber and Kevler fiber, fills the bag 36.

Accordingly, strong tension is applied to the bag 36 because of the pressurized gas inside the bag 36. However, the volume of the bag 36 does not exceed a certain volume.

According to the six embodiment, when a high pressure portion caused by the pressure pulsation of the fuel supplied through the high pressure fuel pipe 3 reaches the inner space 6*a* or 7*a,* it enters the damping chamber 11 via the opening 9*a* or 10*a* because the bag 36 is inserted in the damping chamber 11.

Accordingly, a part of the bag 36 is deformed by the high pressure portion as shown in FIG. 9A. The volume of the bag 36 is slightly decreased to absorb the high pressure portion of the pressure wave. Then, when a low pressure portion reaches the inner space 6*a* or 7*a,* the bag 36 returns to the initial shape to increase the pressure of the low pressure portion.

Thus, the pressure pulsation in the inner space 6*a* and 7*a* are reduced, and the pressure pulsation in the entire system is also reduced. Accordingly, the injection quantity fluctuation of the injectors 4 caused by the pressure pulsation of the supplied fuel is reduced.

FIG. 9B shows a state of the bag 36 when the high pressure portion of the pressure wave reaches the inner space 6*a.* FIG. 9C shows a state of the bag 36 when the low pressure portion of the pressure wave reaches the inner space 7*a.*

Figure 10:
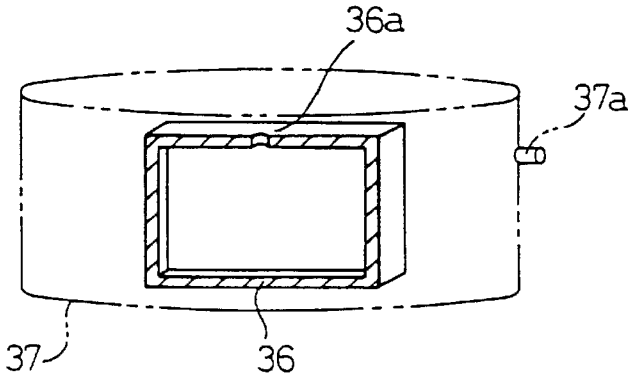
FIG. 10 is a perspective illustration showing a manufacturing process of an inner bag used for the pressure relaxation device according to the sixth embodiment of the present invention.

FIG. 10 shows a part of manufacturing processes of the bag 36 used for the pressure relaxation device 35 in the sixth embodiment.

The bag 36 having a hole 36*a* is obtained by a prior process to unify the rubber with the fiber bag. After setting the bag 36 into a high pressure container 37, high pressure gaseous nitrogen or the like is supplied through an inlet 37*a* of the container.

The high pressure gas enters not only the outside of the bag 36 but also the inside of the bag 36 via the hole 36*a.* After waiting shortly until the inner pressure and the outer pressure are balanced, the hole 36*a* is filled with raw rubber or the like, and seal it by heating. Accordingly, the bag 36 filled with high pressure gas is obtained.

There are other ways to fill the high pressure gas in the bag 36. For example, liquefied inert gas, such as liquid nitrogen, may be poured into the bag 36 via the hole 36*a,* and seal the hole 36*a* immediately. The poured liquefied gas turns into the gas phase under the ordinary temperature to sufficiently increase the inner pressure of the bag 36.

In this case, instead of sealing the hole 36*a* by the rubber which is the same material used for the bag 36, a mechanical valve may be used, and the high pressure gas may be filled with the bag 36 by opening and closing the valve.

(Seventh Embodiment)

A designing method of a fuel supply system according to a seventh embodiment of the present invention will now be described.

Figure 11:
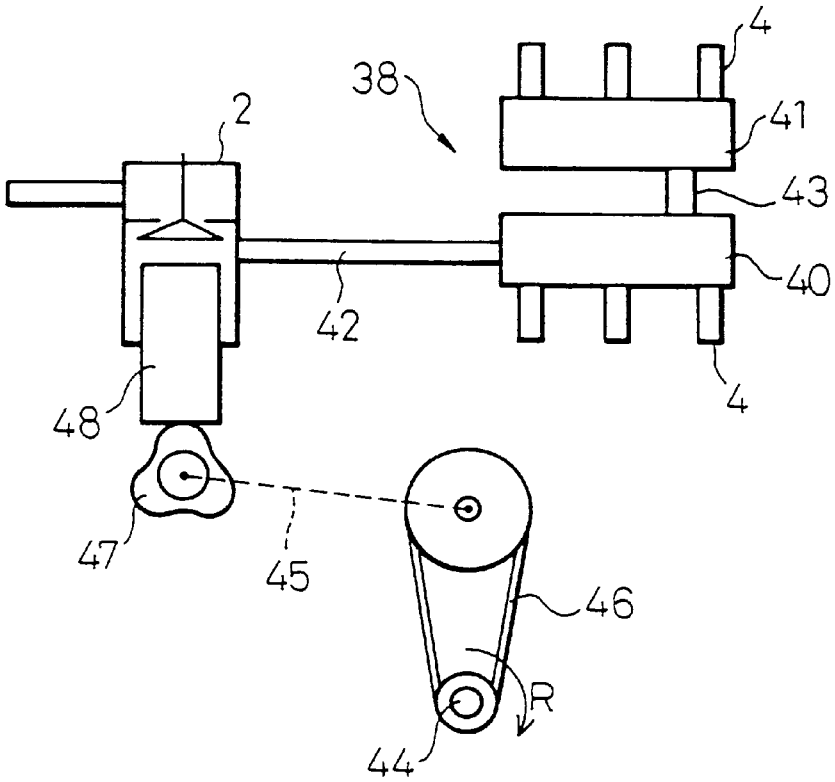
FIG. 11 is a schematic illustration showing a fuel supply system to be designed by a designing method according to a seventh embodiment of the present invention.

A fuel supply system 38 of the seventh embodiment has a structure illustrated in FIG. 11 to apply it to a six cylinder V-type engine. The fuel supply system 38 of the seventh embodiment is an improvement of a conventional fuel supply system 39 illustrated in FIG. 12.

The fuel supply system 38 of the seventh embodiment has a right delivery pipe 40 and a left delivery pipe 41 for the right cylinder group and the left cylinder group of a not shown V-type direct injection engine, that is for the right bank and the left bank respectively. Each of the right and left delivery pipes 40 and 41 is made of a pipe-shaped pressure storing container having a large cross section, and has three injectors 4 for injecting fuel into cylinders of the respective banks.

In the seventh embodiment, one end of the right delivery pipe 40 is connected to the discharge side of the fuel pump 2 via a connecting pipe 42, and a part of the right delivery pipe 40 adjacent to the other end of the right delivery pipe 40 is connected to a part of the left delivery pipe 41 adjacent to one end of the left delivery pipe 41 via a connecting pipe 43.

Respective timing pulleys are attached to a crank shaft 44 and a cam shaft 45 of an engine. A timing belt 46 is provided between the timing pulleys to form an ordinary cam driving mechanism.

A pump-driven cam 47 having three teeth is attached to the cam shaft 45. A pump plunger 48 of the fuel pump 2 driven by the pump-driven cam 47 to reciprocate for pressurizing fuel supplied to the injectors 4 is slidably provided in a cylinder.

Figure 12:
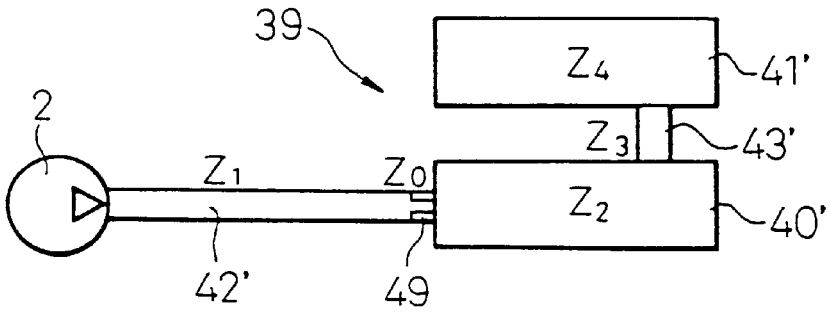
FIG. 12 PRIOR ART
FIG. 12 is a schematic illustration showing a fuel supply system according to a prior art.

According to the conventional fuel supply system 39 illustrated in FIG. 12, however, design data, such as cross sectional are (thickness) and length, of a right and left delivery pipes 40' and 41' and connecting pipes 42' and 43' are different from those in the seventh embodiment, and it has an orifice 49 in the connecting pipe 42' for relaxing the pressure pulsation.

According to a known method for designing a fuel supply system, resonance frequency of the system, that is natural frequency, is calculated to reduce the pressure pulsation of the fuel, and an impedance method is used therefor. In order to calculate the resonance frequency (R.F.) of the conventional fuel supply system 39 shown in FIG. 12 by using the impedance method, $Z_0$ to $Z_4$ shown in Table 1 are calculated by changing frequency f by 0.1 Hz by a computer. $Z_0$ to $Z_4$ are impedance for respective parts of the fuel line of the fuel supply system 39.

As shown in Table 1, only the impedance $Z_0$ for the orifice 49 is a constant value irrelevant to the frequency f. In this case, the necessary bulk modulus K is one of the physical values of the fuel (gasoline), and it is for example 600 MPa.

TABLE 1

| | |
|---|---|
| $Z_1$ for connecting pipe | $Z_1 = 2\pi fm_1 j \quad m_1 = \rho L_1/S_1$<br>j: imaginary number, ρ: density,<br>$L_1$: length, $S_1$: cross-sectional area |
| $Z_0$ for orifice | $Z_0 = \rho c/S_2 \quad c = \sqrt{(K/\rho)}$<br>c: transfer speed of pressure wave,<br>K: bulk modulus, $S_2$: cross-sectional area |
| $Z_2$ for right delivery pipe | $Z_2 = -j/2\pi fC_2 \quad C_2 = V_2/\rho c^2$<br>$V_2$: volume of right delivery pipe |
| $Z_3$ for connecting pipe | $Z_3 = 2\pi fm_3 j \quad m_3 = \rho L_3/S_3$ |
| $Z_4$ for left delivery pipe | $Z_4 = -j/2\pi fC_4 \quad C_4 = V_4/\rho c^2$<br>$V_4$: volume of left delivery pipe |

After calculating respective impedance $Z_0$ to $Z_4$ for various frequencies f, total impedance Z is obtained from $Z_0$ to $Z_4$ and the following Equation 1.

$$\text{Total impedance } Z=Z_1+Z_0+\{1/[1/Z_2+1/(Z_3+Z_4)]\} \qquad \text{[Equation 1]}$$

The total impedance Z is an impedance, as a function of the frequency f of the pressure pulsation, of the entire fuel supply system 39 on the basis of the fuel pump 2. One frequency f at which the total impedance Z rapidly increases among various frequencies f is determined as the resonance frequency of the fuel supply system 39.

Frequency or resonance frequency of the pressure pulsation is changed by changing the design data of the system 39 such that the resonance frequency does not coincide with the pressure pulsation frequency of the pressurized fuel in the fuel supply system 39 generated by intermittent discharge of the pressurized fuel from the fuel pump 2 or opening/closing operation of the injectors 4.

The conventional fuel supply system 39 has the orifice 49 on the connecting pipe 42' or an inlet of the right delivery pipe 40 in order to reduce the pressure pulsation caused by the intermittent fuel discharge by the plunger of the fuel pump 2. The orifice 49 needs to have a very fine diameter because the fuel is gasoline.

Accordingly, it may be difficult to supply small amount of fuel precisely during the lean burn because vapor release is prevented by the small orifice 49. Furthermore, foreign substance tends to be stuck at the small orifice 49.

Furthermore, the resonance frequency (natural frequency) of the system may resonate with the high frequency of the pressure pulsation because the response is not sufficient for the high frequency, that is a frequency of a harmonics having two or several times bigger than that of the discharge pulsation of the fuel pump 2.

Figure 13:
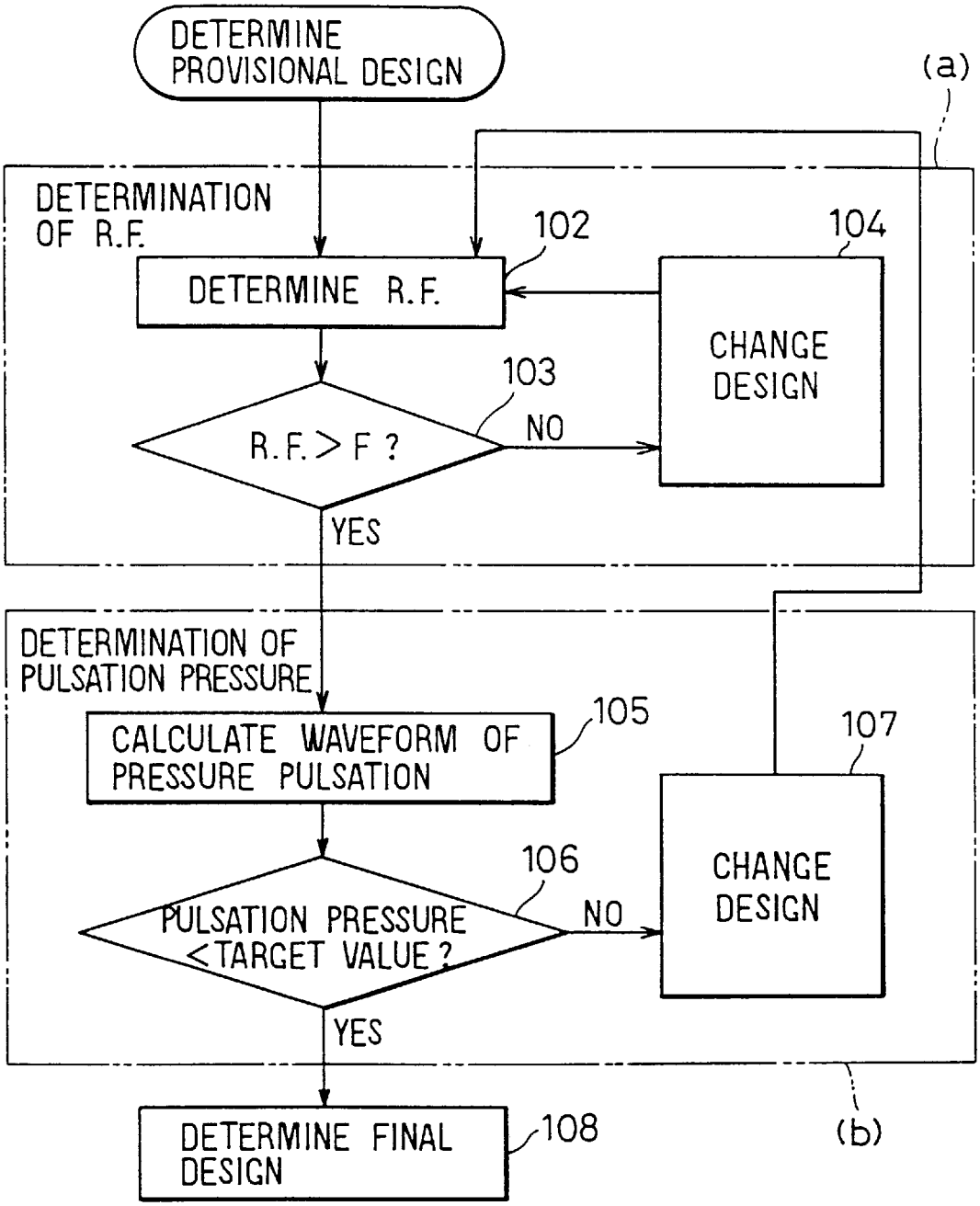
FIG. 13 is a flowchart showing the designing method according to the seventh embodiment of the present invention.

In light of the above problems, processes shown in a flowchart of FIG. 13 are employed by the seventh embodiment for determining the design data for the fuel supply system, that is size and the like of each part. Accordingly, the fuel supply system which certainly prevents the resonance caused by the pressure pulsation of the pressurized fuel is easily designed.

The main content of the designing method of the flowchart shown in FIG. 13 is to repeat the calculations by changing conditions such as the frequency. Accordingly, the most parts of the content are required to be performed by a computer. In that sense, it is possible to say that FIG. 13 illustrates a design calculation program for the fuel supply system 38 by the computer.

When the program for designing the fuel supply system starts, a provisional pipe design for the entire fuel supply system is determined in step 101. For example, it is desirable to prepare in advance several kinds of pipe designs, such as the one for the fuel supply system 38 shown in FIG. 11. One of them is used for the calculation for an evaluation.

In step 102, the resonance frequency (R.F.) of the fuel supply system 38 used in the previous step 101 is calculated by the conventional impedance method explained in the Table 1 and the Equation 1 herein.

In step 103, a predetermined target frequency F under the operation of the fuel supply system 38 is compared with the resonance frequency calculated in the previous step. The target frequency F is defined by the following Equation 2:

$$F=R\cdot t\cdot n/60 \qquad \text{[Equation 2]}$$

where R represents a maximum value of the normal engine speed (rpm), and t represents revolutions of the fuel pump 2 divided by the engine speed (t=1.5 when the pump driven cam 47 has three teeth), and n represents an order frequency of a range to be reduced from the harmonics of the discharge pulsation of the fuel pump 2 (n=4 when a range up to fourth harmonics of the discharge pulsation is to be reduced).

When it is determined in step 103 that the calculated resonance frequency is not greater than the target frequency F (NO), it proceeds to step 104 because the target frequency of the fuel pump 2 may resonate with the resonance frequency.

In step 104, design data of a part which may generate the resonance, that is, diameters, lengths and the like of the connecting pipes 42, 43 and the right and left delivery pipes 40, 41 are changed in order to increase the resonance frequency. Then, it returns to step 102 to repeat the calculation of the resonance frequency and the determination with the target frequency F described above.

In FIG. 13, a first block (a) enclosed by a two-dot chain line shows steps for calculating design data of the fuel supply system 38 necessary for avoiding the resonance and for calculating the resonance frequency.

When it is determined in step 103 that the resonance frequency is greater than the target frequency F, it is tentatively considered that the resonance is prevented by the design data of the fuel supply system 38. To make it sure, the seventh embodiment executes a second block (b) enclosed by a two-dot chain line in FIG. 13, that is determination processes by pulsation pressure, to confirm whether the resonance is caused by the pressure pulsation, mainly by the harmonics, and the design data, such as the size of the delivery pipes 40, 41 and the connecting pipes 42, 43, may be changed for some cases.

Since the fundamental frequency of the pressure pulsation caused by the discharge pulsation of the fuel pump 2 or opening/closing valves of the injectors 4 is relatively small, it is relatively easy to set the resonance frequency of the fuel supply system greater than the fundamental frequency.

However, it is not easy to avoid high frequencies of the harmonics that are integral multiples of the fundamental frequency. Accordingly, even if the processes in the block (a) are executed based on the comparison between the pressure pulsation frequency, that is the fundamental frequency and a frequency of a high harmonics which is in multiples of two or three and which is expected to resonate, and the resonance frequency, a possibility to generate the resonance by synchronizing the high harmonics frequency with the natural frequency of the system still remains even for the pressure pulsation at a range of the normal engine speed.

Since it is impossible to take measures against all harmonics, realistic processes to change the design data only for the harmonics which generates a resonance having a large amplitude are shown in the second block (b).

Specifically, when it is determined YES in step 103, it proceeds to step 105 to calculate the pressure pulsation wave form of the fuel supply system 38 by the numerical analysis. A publicly available computer software may be used for the numerical analysis.

Accordingly, the waveform and the amplitude of the pressure pulsation is determined. Thus, at least the reason why several peaks appear on the waveform in the range of the normal engine speed is obtained. In other words, which harmonics (multiple number of harmonics) of the pressure pulsation in the fuel supply system generates the resonance is determined.

In step 106, an amplitude of the pulsation pressure is compared with a predetermined target value. When the amplitude of the pulsation pressure is greater than the target value (NO), it proceeds to step 107 to change the design data of a part, such as a part which transmits a vibrational force. For example, the bigness or length of the connecting pipe 42 between the fuel pump 2 and the right delivery pipe 40 may be changed, or the cross sectional area of a restriction, such as a small diameter pipe, at the entrance of the delivery pipes 40 and 41 may be changed.

It is relatively easy to take such measures because the resonance frequency having large amplitude and the multiple number of the harmonics which causes the resonance are known in step 105.

After finishing the step 107, it may return to step 105, but according to the flowchart shown in FIG. 7, it returns to step 102 instead just in case to re-execute the evaluation processes by the frequency in the first block (a) and re-execute the evaluation processes by the amplitude of the pulsation pressure in the second block (b) thereafter.

In short, it proceeds to step 108 when it is determined YES in step 106 to manufacture a part of or whole system, confirm the performance by experiments, and determine the final design.

It will now be described about "design data" to be changed for the purpose of changing the resonance frequency (natural frequency) of the fuel supply system or the amplitude of the pulsation pressure.

According to the fuel supply system 38 illustrated in FIG. 11, inner diameters (bigness) or lengths of the connecting pipes 42 or 43 and inner diameters (bigness) or lengths of the delivery pipes 40 or 41 for determining the volume of the delivery pipes 40 or 41 are the "design data".

Figure 14A:
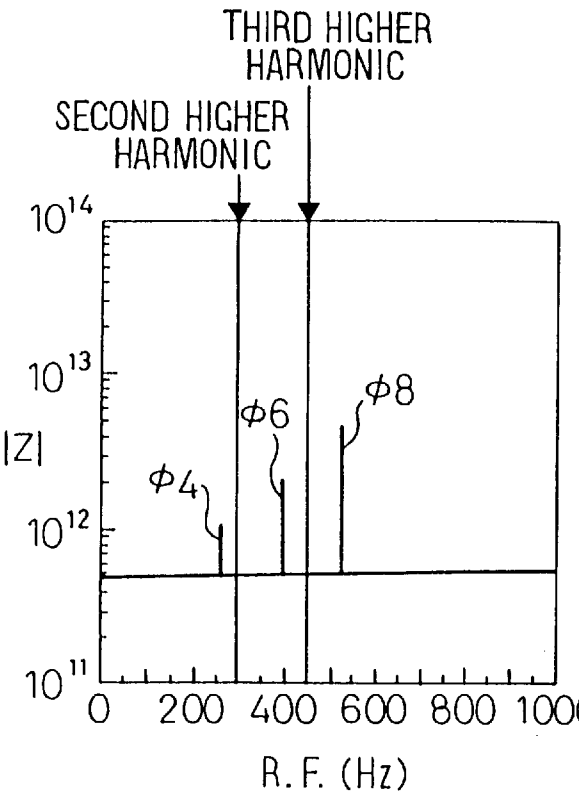
FIG. 14A is a graph showing a relation between an inner diameter of a connecting pipe and a resonance frequency and a total impedance of the fuel supply system according to the seventh embodiment of the present invention.
Figure 14B:
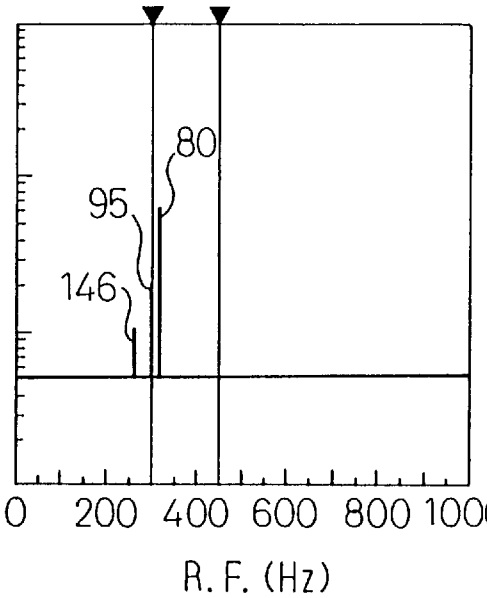
FIG. 14B is a graph showing a relation between a length of the connecting pipe and the resonance frequency and the total impedance of the fuel supply system according to the seventh embodiment of the present invention.
Figure 14C:
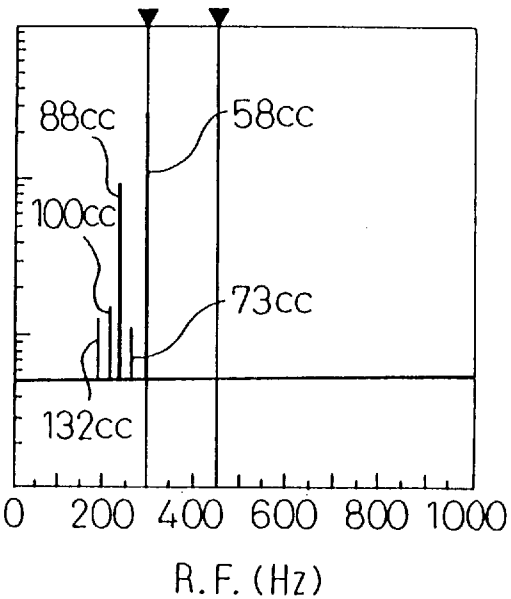
FIG. 14C is a graph showing a relation between a total volume of a delivery pipe and the resonance frequency and the total impedance of the fuel supply system according to the seventh embodiment of the present invention.

Among these design data, there is a priority regarding the effect, such as the one having a great influence on the resonance frequency and the one not having a great influence on the resonance frequency. FIGS. 14A, 14B and 14C show how the resonance frequency varies when the inner diameter and length of the connecting pipe 43 and the total volume of the delivery pipes 40 and 41 are changed respectively. In FIG. 14C, the volume is a total volume of right and left delivery pipes 40 and 41.

It is apparent from FIGS. 14A to 14C that the resonance frequency shown by the peak of the impedance Z significantly shifts toward the higher frequency when the inner diameter of the connecting pipe 43 is increased. On the contrary, the resonance frequency slightly (not significantly) shifts toward the higher frequency when the length of the connecting pipe 43 is shortened. Furthermore, the resonance frequency slightly (not significantly) shifts toward the higher frequency when the total volume of the delivery pipes 40 and 41 is reduced.

In FIGS. 14A to 14C, the fundamental frequency of the discharge pulsation of the fuel pump 2 is 150 Hz, and the second higher harmonics frequency is 300 Hz, and the third higher harmonics frequency is 450 Hz. When it is necessary to avoid the resonance with not only the fundamental frequency but also with the second and third higher harmonics frequencies, it is preferable to set the each inner diameter of the connecting pipes 43 and 42 to 8 mm as shown in FIG. 14A.

In FIGS. 14A to 14C, a frequency shown by the peak of the total impedance Z of the fuel supply system is a resonance frequency corresponding to the design data shown in FIGS. 14A to 14C. However, the height of the peak of the total impedance Z is not necessarily showing the strength (amplitude) of the resonance. A strong resonance may occur even if the height of the peak is low.

(Eighth Embodiment)

Figure 15:
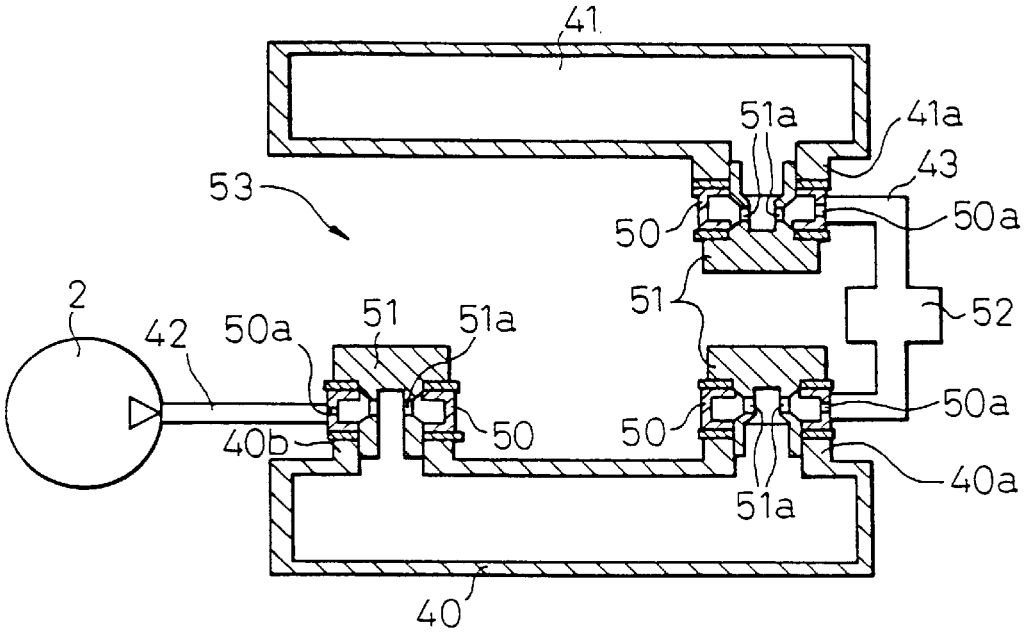
FIG. 15 is a schematic illustration showing a fuel supply system according to an eighth embodiment of the present invention.
Figure 16:
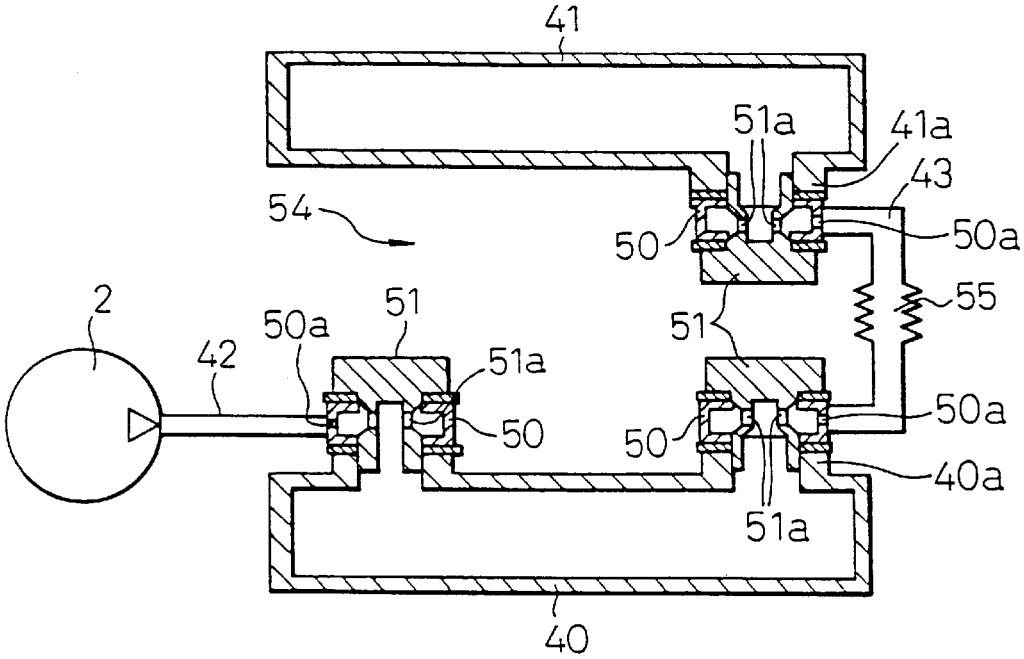
FIG. 16 is a schematic illustration showing a fuel supply system according to a ninth embodiment of the present invention.
Figure 17:
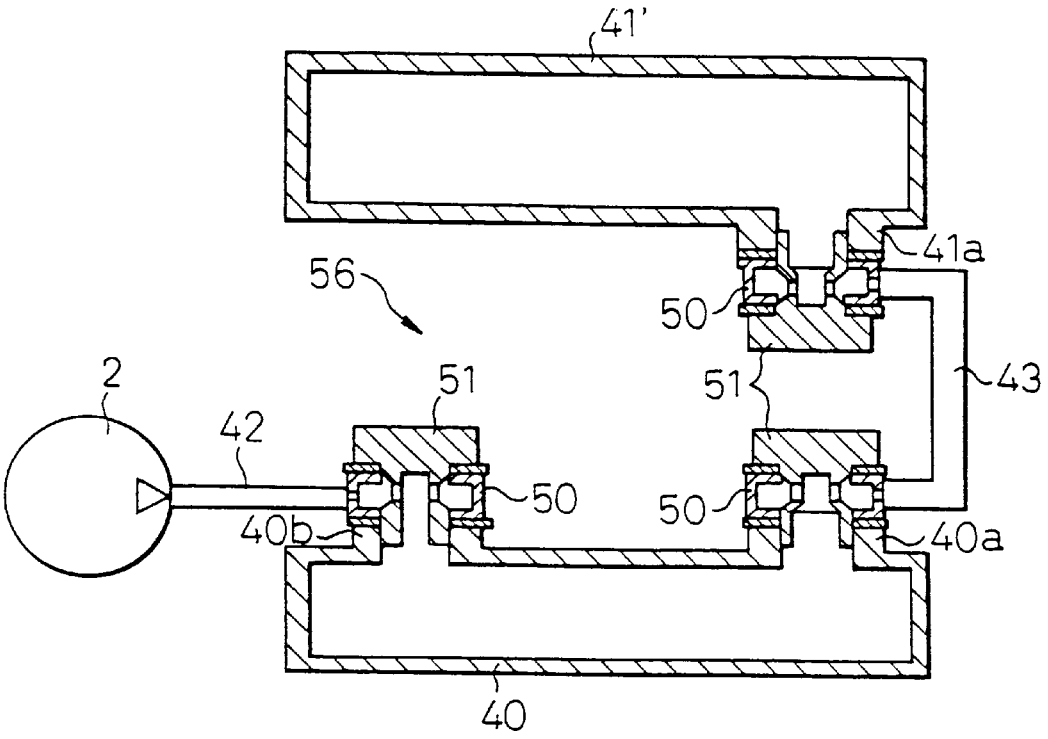
FIG. 17 is a schematic illustration showing a fuel supply system according to a tenth embodiment of the present invention.
Figure 18:
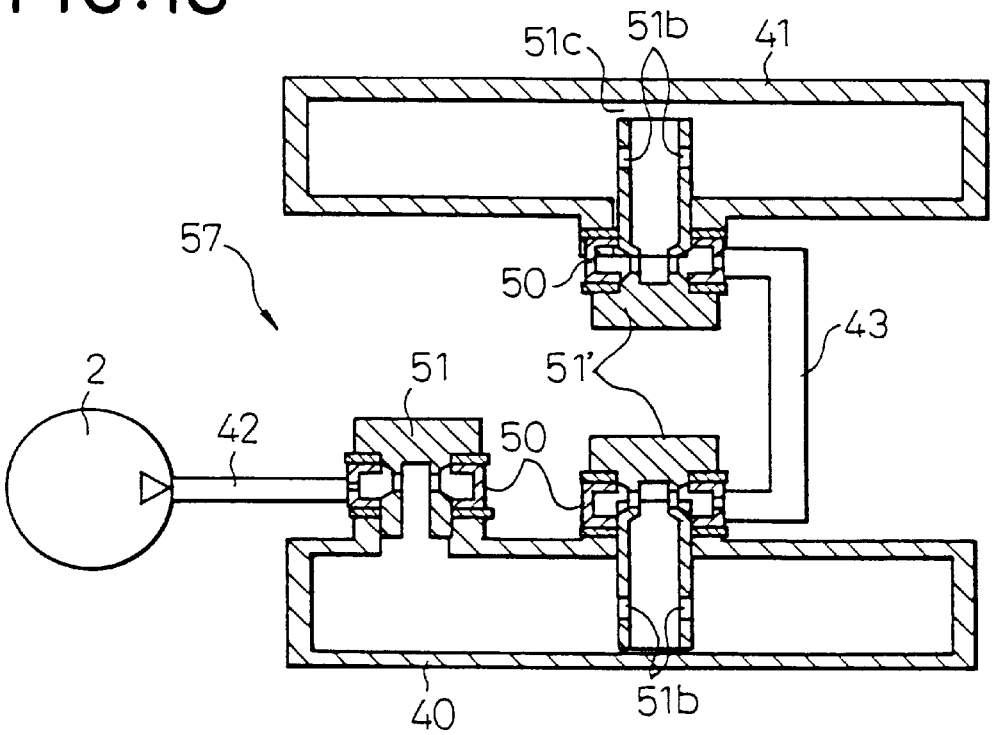
FIG. 18 is a schematic illustration showing a fuel supply system according to an eleventh embodiment of the present invention.

A fuel supply system of an eighth embodiment of the present invention shown in FIG. 15 has been developed based on the system design method explained in the seventh embodiment and informations regarding the change of the design data obtained by various studies of the design method and shown in FIGS. 14A to 14C. In that sense, the following ninth to eleventh embodiments of the present invention illustrated in FIGS. 16 to 18 are similar to the eighth embodiment.

As illustrated in FIG. 15, protruded portions 40*a* and 41*a* protruding to each other are formed on the delivery pipes 40 and 41 respectively. The protruded portions 40*a*, 41*a* and a ring 50 and a union bolt 51 are integrated in a fluid-tight manner because an external thread of the union bolt 51 is screwed in an internal thread of the protruded portions 40*a*, 41*a* via the ring 50 having a U-shaped cross section and a washer or a seal ring or the like.

The union bolt 51 has a communication hole 51*a* for communicating the inside of the protruded portion 40*a* or 41*a*, that is the inside of the delivery pipe 40 or 41, with the inside of the ring 50. The ring 50 has a communication hole 50*a*. Both ends of the connecting pipe 43 are connected to the ring 50 by welding or the like such that the delivery pipes 40 and 41 are connected at the communication hole 50*a*.

In the eighth embodiment, the connecting pipe 43 has a U shape because the connecting pipe 43 is connected to the protruded portions 40*a* and 41*a* at the side of the ring 50. The reason of this shape is that it is often difficult to connect the protruded portions 40*a* and 41*a* with the straight connecting pipe 43 because an intake air system or the like is usually provided between the two banks of the V-type engine. If there is no obstacle between the protruded portions 40*a* and 41*a*, it is better to use a shorter and straight connecting pipe 43.

The first feature of the eighth embodiment is to provide an enlarged volume portion 52 having an enlarged diametrical portion on a part of the connecting pipe 43 connecting the protruded portions 40*a* and 41*a*.

The second feature of the eighth embodiment is to set the effective diameter of the inner space of the protruded portions 40*a*, 41*a* is set greater than the inner diameter of the connecting pipe 43 even after screwing the union bolt 51. Accordingly, average diameter and volume of the connecting portion between the delivery pipes 40 and 41 are significantly increased comparing to those of the connecting pipe 43.

Furthermore, the third feature of the eighth embodiment is that the length of the connecting pipe 43 is substantially shortened by protruding the protruded portions 40*a* and 41*a* to each other.

The connecting pipe 42 is connected to the right delivery pipe 40 to receive the pressurized fuel from the fuel pump 2. The connecting portion between the right delivery pipe 40 and the connecting pipe 42 comprises a protruded portion 40*b* which has a similar shape to the protruded portions 40*a*, 41*a*, and the ring 50 and the union bolt 51. However, it is not necessary to have such the same structure, and the connecting portion between the right delivery pipe 40 and the connecting pipe 42 may employ other shape and structure.

Since the fuel supply system 53 of the eighth embodiment shown in FIG. 15 has the above described structure, the enlarged volume portion 52 formed on the connecting pipe 43 and the inner space having the enlarged effective inner diameter of the protruded portions 40*a* and 41*a* significantly enlarge the average inner diameter of the connecting portion between the delivery pipes 40 and 41 including the connecting pipe 43.

Accordingly, the fundamental frequency, that is the natural frequency, of the fuel supply system 53 is significantly increased as apparent from FIG. 14A regarding the explanation in the seventh embodiment.

Thus, among the pressure pulsation of fuel flowing in the fuel supply system 53, not only the resonance with the lower multiplied harmonics but also the resonance with the higher multiplied harmonics are certainly prevented by adding the simple structure that the connecting pipe 43 has the enlarged volume portion 52.

Furthermore, since the substantial length of the connecting pipe 43 is shortened by forming the protruded portions 40*a* and 41*a*, shifting of the resonance frequency to the higher direction is facilitated as shown in FIG. 14B.

(Ninth Embodiment)

A fuel supply system 54 of a ninth embodiment of the present invention is illustrated in FIG. 16.

The difference between the eighth embodiment and the ninth embodiment is that the enlarged volume portion 52 in the eighth embodiment is replaced by a flexible member 55 which is slightly flexible, thick and rigid made of a strong and oilproof synthetic rubber or the like.

Since the flexible member 55 has an enlarged diameter portion similar to the enlarged volume portion 52 in the eighth embodiment, the resonance frequency of the fuel supply system 54 in the ninth embodiment is increased, and the occurrence of the resonance with the pressure pulsation in the system 54 is prevented. Furthermore, since the connecting pipe 43 has a flexibility, the assembly of an engine is facilitated, and breakage of a connecting portion, such as the connecting pipe 43, caused by the vibration of an engine is prevented.

(Tenth Embodiment)

A fuel supply system 56 of a tenth embodiment of the present invention is illustrated in FIG. 17.

The difference between the eighth or ninth embodiment and the tenth embodiment is that the volume of the downstream side left delivery pipe 41' is greater than that of the upstream side right delivery pipe 40 in the tenth embodiment.

The pulsation width (amplitude) of the pressure pulsation of the pressurized fuel in the right delivery pipe 40 and that in the left delivery pipe 41' are different because the right delivery pipe 40 and the left delivery pipe 41' are connected in series via the connecting pipe 43 having relatively small diameter.

Therefore, the volume of the left delivery pipe 41' is increased such that the pulsation width of the pressure pulsation in the left delivery pipe 41' becomes the same as the one in the right delivery pipe 40. Accordingly, fluctuation of fuel injection quantity between the cylinders of the left bank and the right bank.

(Eleventh Embodiment)

A fuel supply system 57 of an eleventh embodiment of the present invention is illustrated in FIG. 18.

The difference between the eleventh embodiment and the previous embodiments is that a union bolt 51' is longer than the union bolt 51 and the inside of the delivery pipe 40 and/or 41 are/is divided into several small rooms in the eleventh embodiment.

The union bolt 51' does not completely divide the inside of the delivery pipe. For example, the union bolt 51' has a communication hole 51*b* or forms a gap 51*c* between a tip thereof and the delivery pipe for allowing the fuel flow from one divided room to the other divided room(s).

According to the eleventh embodiment, the resonance frequency (natural frequency) of the delivery pipes 40 and 41 is increased by dividing the inside of the delivery pipes 40 and/or 41 into several small rooms because of the same reason described above with reference to FIG. 14C. Accordingly, the pressure pulsation and the resonance with its harmonics are prevented.

(Twelfth Embodiment)

It has already been described in this specification that the total impedance Z is calculated by determining the respective impedances $Z_0$ to $Z_4$ of the system (see Table 1) and summating them according to the Equation 1 when the resonance frequency, that is the natural frequency, of the fuel supply system shown in FIG. 12 is calculated.

Figure 19:
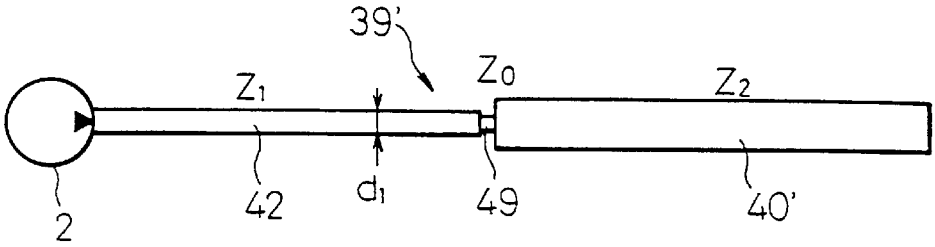
FIG. 19 PRIOR ART
FIG. 19 is a schematic illustration showing a fuel supply system according to a prior art.

A conventional fuel supply system 39' shown in FIG. 19 having simpler structure than the one shown in FIG. 12 is known as a fuel supply system which is capable of being used for an inline type multiple cylinder engine.

In this case, a plurality of injectors (not shown) are installed in a single delivery pipe 40' to inject fuel directly to respective cylinders. A tip of the downstream side of the connecting pipe 42 connected to the fuel pump 2 supplies pressurized fuel to the delivery pipe 40' via the restricted orifice 49 which is to reduce the pressure pulsation.

Total impedance Z of the fuel supply system 39' shown in FIG. 19 is calculated from the following Equation 3:

$$Z=Z_1+Z_0+Z_2 \quad \text{[Equation 3]}$$

where $Z_1$ represents impedance of the connecting pipe 42, and $Z_0$ represents impedance of the restricted orifice 49, and $Z_2$ represents impedance of the delivery pipe 40'.

Figure 20A:
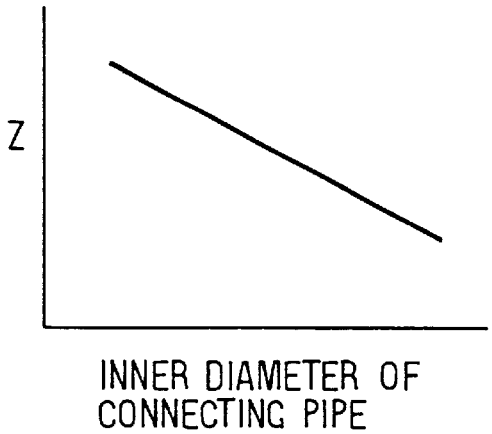
FIG. 20A is a graph showing a relation between an inner diameter of a connecting pipe and an impedance of a fuel supply system according to a twelfth embodiment of the present invention.
Figure 20B:
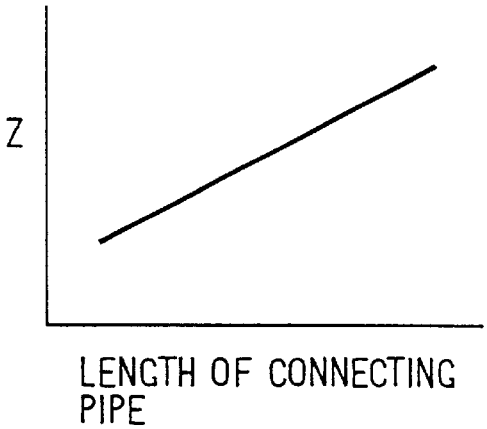
FIG. 20B is a graph showing a relation between a length of the connecting pipe and the impedance of the fuel supply system according to the twelfth embodiment of the present invention.
Figure 20C:
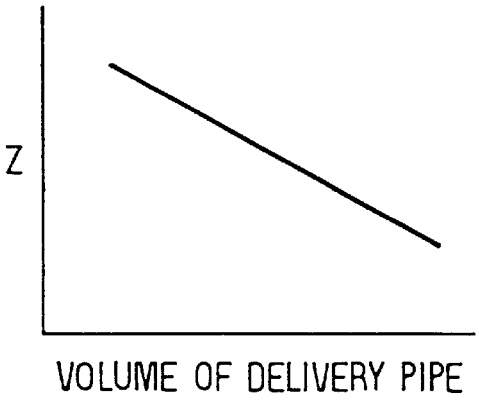
FIG. 20C is a graph showing a relation between a total volume of a delivery pipe and the impedance of the fuel supply system according to the twelfth embodiment of the present invention.

As described before, in order to prevent the resonance caused by synchronization with the frequency of the pressure pulsation in the system 39', the resonance frequency of the system should be shifted to the higher frequency side by reducing the total impedance Z of the piping system as much as possible. To achieve the frequency shift, parameters for increasing or decreasing the total impedance Z should be determined as follows because of the reasons shown in FIGS. 20A to 20C:

(a) The inner diameter of the connecting pipe 42 should be as large as possible;

(b) The length of the connecting pipe 42 should be as small as possible; and (c) The volume of the delivery pipe 40' should be as large as possible.

The impedance $Z_1$ of the connecting pipe 42 is equal to $2\pi f m_1 j$ as described in Table 1.

$$m_1=\rho L_1/S_1=4\rho L_1/\pi d_1^2 \quad \text{[Equation 4]}$$

where $d_1$ represents the inner diameter of the connecting pipe 42.

Therefore, the impedance $Z_1$ of the connecting pipe 42 is decreased in inverse proportion to $d_1$ squared. Thus, the change of the inner diameter $d_1$ of the connecting pipe 42 has the greatest influence among the above three kinds of parameters. According to the above fact, the inner diameter $d_1$ of the connecting pipe 42 should be as large as possible as described above to reduce the impedance $Z_1$, that is the total impedance Z.

Figure 21:
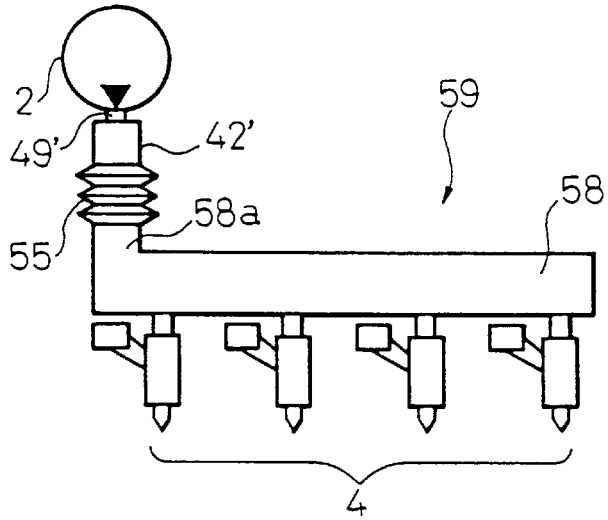
FIG. 21 is a schematic illustration showing a fuel supply system according to the twelfth embodiment of the present invention.

A fuel supply system of a twelfth embodiment of the present invention utilizing the above fact and the nature is illustrated in FIG. 21.

A connecting portion 58*a* which connects a delivery pipe 58 to the fuel pump 2 is integrally formed with the delivery pipe 58, and has a large diameter. A connecting pipe 42', connected to the connecting portion 58*a* via the flexible member 55, also has a large diameter.

Since the connecting pipe 42' and the connecting portion 58*a* have high rigidity, the flexible member 55 makes the structure flexible, and facilitates the assembly. Furthermore, a restricted orifice 49' is provided between the fuel pump 2 and the connecting pipe 42' as an auxiliary means for reducing the pressure pulsation.

According to the prior art illustrated in FIG. 12, the restricted orifice 49 is required to have a very small diameter. Therefore, it has various problems that foreign matters tend to stuck at the restricted orifice 49, certain fuel injection quantity may not be secured, it may be difficult to dry the inside of the system after the surface treatment in the manufacturing process, and the like.

According to the fuel supply system 59 of the twelfth embodiment, however, the restricted orifice 49' is the auxiliary means for reducing the pressure pulsation and is not the sole pressure pulsation reducing means. Accordingly, the effective diameter of the restricted orifice 49' may be larger than that of the prior art without causing the problems described in the above prior art.

(Thirteenth Embodiment)

As described above, when the inner diameter $d_1$ of the connecting pipe 42 connecting the fuel pump 2 and the delivery pipe is set as large as possible, the impedance $Z_1$ is effectively reduced, and the resonance frequency of the system shifts toward the higher frequency side. As a result, the resonance with the pressure pulsation is not likely to occur relatively.

Same theory is applicable to the connecting pipe 43 connecting the delivery pipes 40 and 41 when a plurality of delivery pipes are provided as illustrated in FIG. 11 for the application to a V-type engine or the like. In other words, the impedance $Z_3$ of the connecting pipe 43 is equal to $2\pi f m_3 j$ as described in Table 1.

$$m_3=\rho L_3/S_3=4\rho L_3/\pi d_3^2 \quad \text{[Equation 5]}$$

where $d_3$ represents the inner diameter of the connecting pipe 43.

Therefore, the impedance $Z_3$ of the connecting pipe 43 is decreased in inverse proportion to $d_3$ squared.

Figure 22:
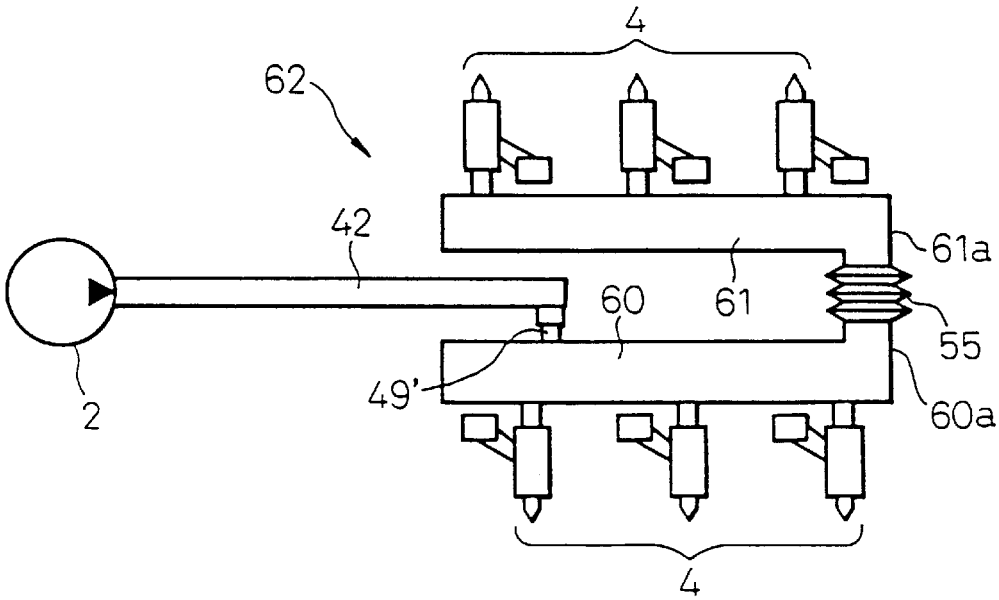
FIG. 22 is a schematic illustration showing a fuel supply system according to a thirteenth embodiment of the present invention.

A fuel supply system of a thirteenth embodiment of the present invention utilizing the above fact and the nature is illustrated in FIG. 22.

Delivery pipes 60 and 61 are integral-type delivery pipes. Large-diameter connecting portions 60*a* and 61*a* are integrally formed with the delivery pipes 60 and 61 respectively for connecting the right delivery pipe 60 to the left delivery pipe 61. Based on the same reason as described above, the connecting portions 60*a* and 61*a* are connected via the flexible member 55.

According to the fuel supply system 62 of the thirteenth embodiment, connecting pipe 42, which connects the upstream side delivery pipe 60 to the fuel pump 2, has an ordinary diameter, and a large-diameter restricted orifice 49' as an auxiliary means for reducing the pressure pulsation is provided between the connecting pipe 42 and the delivery pipe 60.

(Fourteenth Embodiment)

Figure 23:
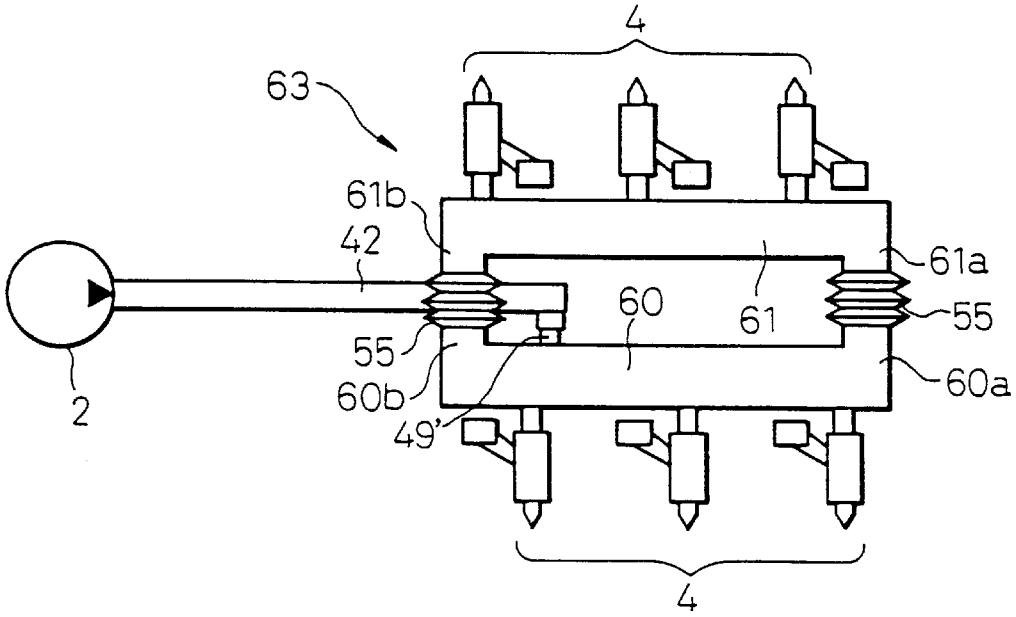
FIG. 23 is a schematic illustration showing a fuel supply system according to a fourteenth embodiment of the present invention.

A fuel supply system 63 of a fourteenth embodiment, as a modification of the fuel supply system 62 of the thirteenth embodiment, is shown in FIG. 23.

In the fourteenth embodiment, integrally formed connecting portions 60*b* and 61*b* are provided on the delivery pipes 60 and 61 as well as the connecting portions 60*a* and 61*a*. Further, these connecting portions 60*b* and 61*b* are connected via the flexible member 55. Accordingly, the high pressure piping of the fuel supply system 63 has a looped-shape.

The loop-shaped high pressure piping and the fuel pump 2 are connected via the connecting pipe 42 similarly to the one in the thirteenth embodiment.

According to the fuel supply system 62 and 63 of the thirteenth and fourteenth embodiments, the total impedance Z is reduced to increase the resonance frequency by increasing the diameter of the connecting portion of the delivery pipe. Accordingly, the pressure pulsation in a normal drive range of an engine and the synchronization with a frequency of the harmonics are prevented, and the resonance is prevented.

(Fifteenth Embodiment)

Figure 24:
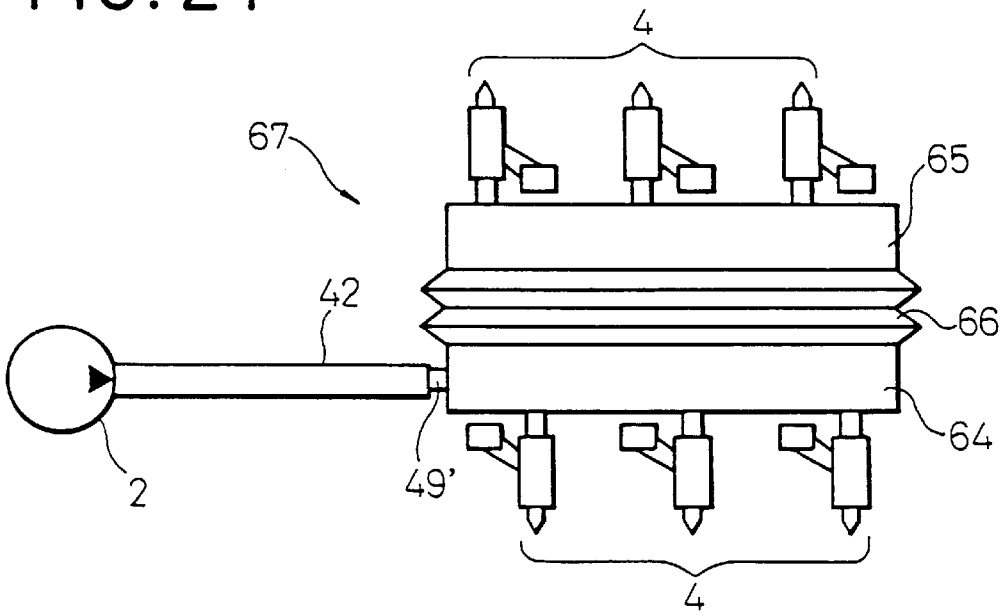
FIG. 24 is a schematic illustration showing a fuel supply system according to a fifteenth embodiment of the present invention.

A fuel supply system 67 of a fifteenth embodiment of the present invention is illustrated in FIG. 24. The fuel supply system 67 has right and left delivery pipes 64 and 65 for a plurality of injectors 4 toward the right and left banks of a V-type engine. The delivery pipes 64 and 65 are connected to each other on entire opposing surfaces without using a connecting pipe or the like to form a unified flat delivery pipe having a large volume.

In the fifteenth embodiment, the entire opposing surfaces are connected via a flexible member 66. Accordingly, the right and left delivery pipes 64 and 65 are slightly movable each other, and thereby facilitating the assembly.

According to the fuel supply system 67 of the fifteenth embodiment, the right and left delivery pipes 64 and 65 are connected via the large connecting portion, and the unified delivery pipe has a significant volume. Accordingly, based on the characteristics shown in FIGS. 20A and 20C, the total impedance Z is significantly reduced, and the resonance frequency is increased, and the resonance is hard to occur in the normal drive range of an engine.

(Sixteenth Embodiment)

Figure 25:
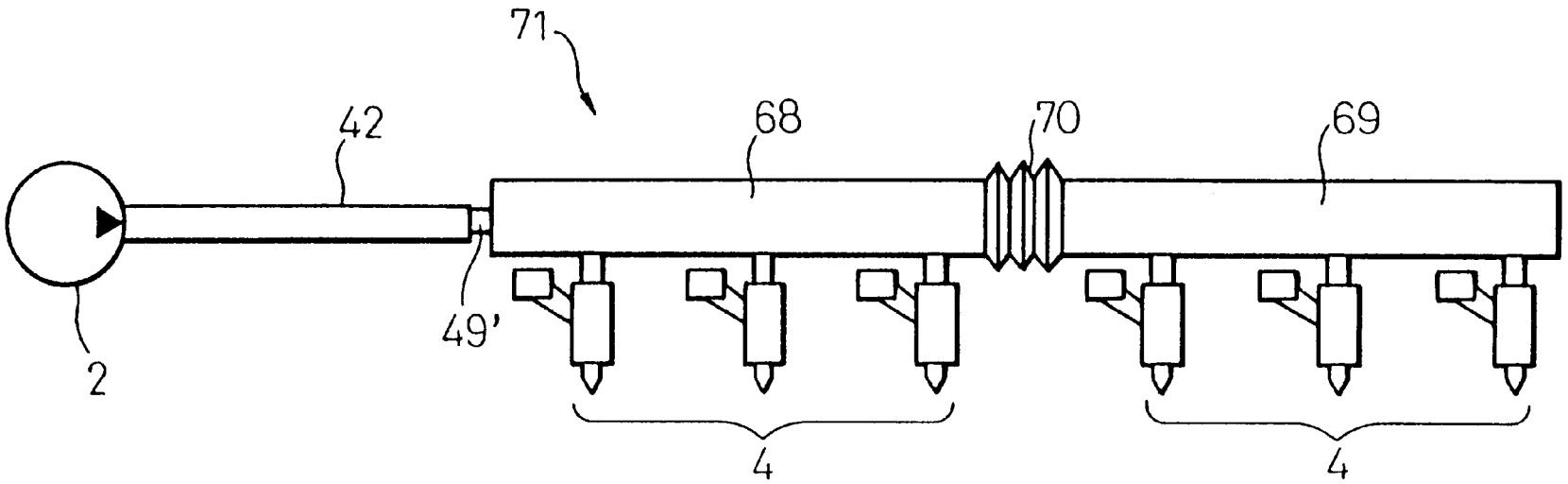
FIG. 25 is a schematic illustration showing a fuel supply system according to a sixteenth embodiment of the present invention.

A fuel supply system 71 of a sixteenth embodiment similar to the fifteenth embodiment is illustrated in FIG. 25.

In the sixteenth embodiment, first delivery pipe 68 and second delivery pipe 69 are connected in series via a flexible member 70 on entire end surfaces of the opposing delivery pipes 68 and 69. Furthermore, the first delivery pipe 68 is connected to the fuel pump 2 via large-diameter restricted orifice 49'.

According to the fuel supply system 71 of the sixth embodiment, operation and advantage similar to the fuel supply system 67 of the fifteenth embodiment are obtained. Although the large-diameter restricted orifice 49' is provided in the fuel supply system 71 of the sixteenth embodiment, it may be omitted if the pressure pulsation is sufficiently reduced because providing the restricted orifice is not essential for the present invention.

(Seventeenth Embodiment)

Figure 26:
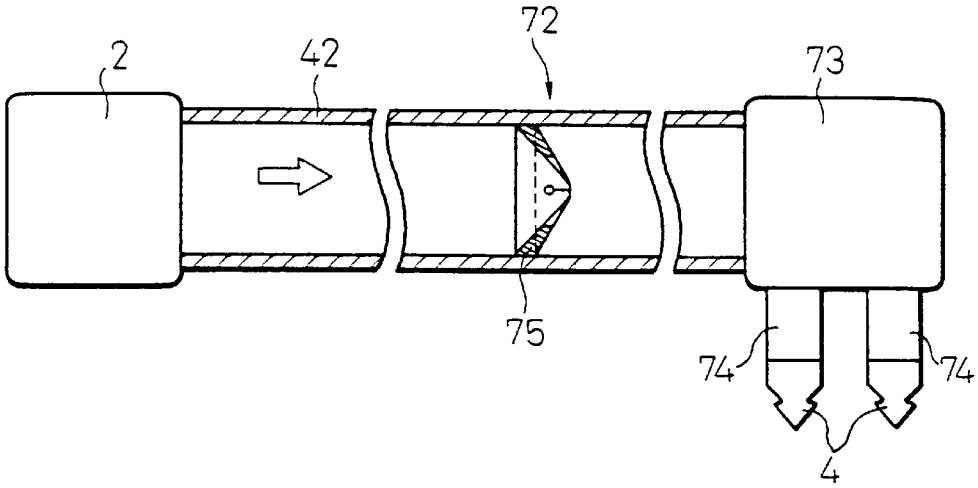
FIG. 26 is a schematic illustration showing a fuel supply system according to a seventeenth embodiment of the present invention.
Figure 27A:
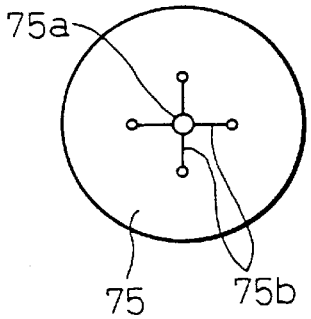
FIG. 27A is an enlarged front view of a main part of FIG. 26 according to the seventeenth embodiment of the present invention.
Figure 27B:
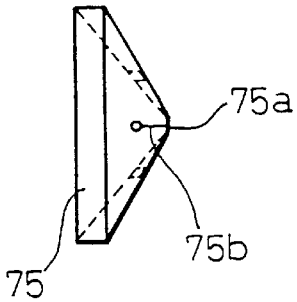
FIG. 27B is an enlarged side view of a main part of FIG. 26 according to the seventeenth embodiment of the present invention.

A fuel supply system 72 of a seventeenth embodiment is illustrated in FIG. 26. The structure of the main portion of the fuel supply system 72 is illustrated in FIGS. 27A and 27B. The main feature of the seventeenth embodiment is to provide a directional restricted orifice 75 on at least one of the connecting pipe 42 and at least one of a plurality of connecting pipes 74. The connecting pipe 42 connects the fuel pump 2 to a delivery pipe 73, and the connecting pipes 74 connect the delivery pipe 73 to the injectors 4.

The restricted orifice 75 which is directional shown in FIGS. 27A and 27B has a conical shape and is made of elastic material such as a spring steel plate or an oilproof synthetic rubber. The restricted orifice 75 has a small opening 75*a* on its center and a plurality of slits 75*b* radially formed from the opening 75*a*.

FIG. 26 illustrates an example that the restricted orifice 75 is installed in a middle of the connecting pipe 42, and the restricted orifice 75 is installed in the connecting pipe 42 such that the tip of the conical shape protrudes toward the downstream side with respect to the fuel pump 2.

According to the fuel supply system 72 of the seventeenth embodiment, not only the opening 75*a* of the restricted orifice 75 but also the slits 75*b* form a large diameter passage for the pressurized fuel flow in a positive direction represented by an arrow illustrated in FIG. 26 when the pressurized fuel is supplied from the fuel pump 2 to the injectors 4 via the connecting pipe 42 or the connecting pipe 74. Accordingly, the pressurized fuel flows with very little resistance from the fuel pump 2 to the delivery pipe 73 and the injectors 4.

However, if the pressure pulsation (pressure wave) caused by the discharge pulsation or the like proceeds to a direction opposite to the positive direction shown by the arrow after being reflected at the end of the high pressure fuel pipes or the like, the slits 75*b* of the restricted orifice 75 close and only the small opening 75*a* opens at the very moment that the pressurized fuel reverses from downstream side to the upstream side.

Accordingly, the reverse flow is reduced. Further, the pressure wave transmission in a reversed direction is substantially prevented because the pressure wave proceeding in the reversed direction receives a large resistance. Furthermore, generation of the vibration and the noise of the high pressure pipes is also prevented.

In this case, when the restricted orifice 75 is made of a material such as a rubber having a flexibility, similar result is obtained without forming the slits 75*b* because the restricted orifice 75 has a direction created only by expansion and shrinkage of the opening 75*a*.

Furthermore, it is possible to have a reed valve which allows only one way flow to the downstream side and to have an orifice formed in the reed valve itself or a partition wall around the reed valve for bypassing the reed valve in order to form a directional orifice.

In the seventeenth embodiment, the opening always expands and shrinks, and it has a substantially large opening cross section. Therefore, a choke caused by a foreign object is prevented.

(Eighteenth Embodiment)

Figure 28:
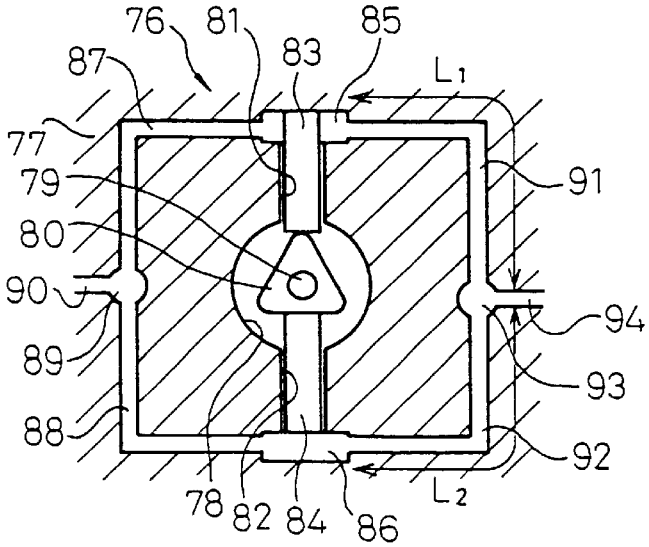
FIG. 28 is a sectional view showing a part of a pressure feed type fuel pump according to an eighteenth embodiment of the present invention.

A main part of a pressure feed type fuel pump 76, capable of being used as the fuel pump 2 for pressurizing fuel in a fuel supply system which injects fuel directly to the cylinders of a direct injection type engine, is illustrated in FIG. 28.

The fuel pump 76 in the eighteenth embodiment includes a cylinder block 77, a drive shaft 79 inserted from the outside into a cum chamber 78 formed in the cylinder block 77, an approximately equilateral triangle shaped cam 80 attached to the drive shaft 79, a pair of cylinders 81 and 82 formed in the cylinder block 77 such that they face each other from 180 degree opposite direction with respect to the drive shaft 79, and a pair of plungers 83 and 84 which are slidably inserted in the cylinders 81 and 82 and whose inner ends are contacting different surfaces of the cam 80. A pair of pressure chambers 85 and 86 are formed facing respective outer ends of the plungers 83 and 84 as a space in the cylinder block 77.

In the cylinder block 77, a pair of divided inlet passages 87 and 88 connected to respective pressure chambers 85 and 86 via an inlet valve not shown, a common inlet chamber 89 connected to upstream side ends of the divided inlet passages 87 and 88, and an inlet passage 90 connected to a low pressure fuel pump (not shown) located at the upstream side are formed.

Furthermore, a pair of divided outlet passages 91 and 92 having substantially the same length ($L_1$=$L_2$) and are connected to the pressure chambers 85 and 86 via an outlet valve not shown, and a common outlet chamber 93 connected to the downstream side ends of the divided outlet passages 91 and 92, and a common outlet passage 94 which is a part of the high pressure pipes connected to a delivery pipe having injectors (not shown) located at the downstream side, and the like are formed.

As the inlet valve provided between the pressure chambers 85, 86 and the divided inlet passages 87, 88 or the outlet valve provided between the pressure chambers 85, 86 and the divided outlet passages 91, 92, it is possible to employ an inlet valve or an outlet valve which is a check valve type or an opening of a cylinder which is opened/closed by a plunger when the plunger slides, similarly to a conventional ones which have been used for a fuel injection pump.

According to the fuel pump 76 of the eighteenth embodiment, when the drive shaft 79 is driven by connecting camshaft of a direct injection type engine not shown, approximately equilateral triangle shaped cam 80 rotates, and the plungers 83, 84 reciprocate with a phase difference of 180 degrees. As a result, pressure of the pressurized fuel generated in the pressure chambers 85, 86 varies as shown in FIGS. 29A and 29B respectively.

In FIGS. 29A to 29C, the ordinate corresponds to fuel pressure, and the abscissa corresponds to rotation angle of the drive shaft 79 and the cam 80.

As apparent from FIGS. 29A and 29B, the pressure pulsations illustrated in FIGS. 29A and 29B in the pressure chambers 85 and 86 are deviated from each other by one half of the wavelength by relatively having 180 degree phase difference.

Accordingly, when the pressurized fuel having the pressure pulsations illustrated in FIGS. 29A and 29B and generated in the pressure chambers 85 and 86 is pressurized and delivered to meet at the discharge chamber 93 via respective discharge valve (not shown) and the divided discharge passages 91 and 92, crests and troughs of the respective pressure pulsations cancel each other. Thus, the pressure of the pressurized fuel in the discharge chamber 93 is equalized in the discharge chamber 93 as shown by the dotted line in FIG. 29C.

Thus, the discharge pulsation of the pressurized fuel introduced from the discharge passage 94 of the fuel pump 76 disappears. Accordingly, the pressurized fuel which has substantially constant pressure is supplied to a delivery pipe not shown, and it is distributed to injectors for respective cylinders. Thus, the fluctuation of the fuel injection quantity and vibrations of the engine and the like caused by the discharge pulsation of the fuel pump are prevented.

When the cam 80 has the approximately equilateral triangle shape, the pressure pulsations in the pressure chambers 85 and 86 are canceled each other in the discharge chamber 93 because the pressure pulsations in the pressure chambers 85 and 86 have the phase difference of one half of the wavelength by defining the locations of a pair of cylinders 81 and 82 in the cylinder block 77, that is by locating the plunger 83 opposite to the plunger 84 by 180 degrees as described in the eighteenth embodiment shown in FIG. 28.

(Nineteenth Embodiment)

Similarly, the angle between a pair of plungers 83 and 84' is set to 60 degrees according to a fuel pump 95 of a nineteenth embodiment shown in FIG. 30 in order to generate a pair of pressure pulsations having a phase difference of one half of the wavelength. The angle between a pair of plungers 83 and 84' may be set to 300 degrees instead.

Generally, when a cam having protrusions equally located around the drive shaft 79 is used, the wavelengths of the pressure pulsations generated in the pressure chambers of a pair of cylinders are deviated from each other by one half of the wavelength when the pair of cylinders are placed on the cylinder block 77 around the drive shaft 79 such that the angular locations of the cylinders are $n\theta/2$, wherein $\theta$ represents an angle between the protrusions, and n represents a random integer. Accordingly, if the pressurized fuel generated in these two pressure chambers is simultaneously introduced to the common discharge chamber 93, the both pressure pulsations cancel each other, thereby reducing the pressure pulsation.

In the eighteenth and nineteenth embodiments, only examples illustrated in FIGS. 28 and 30 having a pair of cylinders are disclosed. However, the number of the cylinders of the fuel pump may be three or greater. In short, the angular locations of a plurality of cylinders are defined to deviate the phase such that the pressure pulsations are canceled each other when pressurized fuel having the pressure pulsations generated in respective pressure chambers of the cylinders meet in the common discharge chamber.

(Twentieth Embodiment)

Furthermore, instead of using the approximately equilateral triangle shaped cam 80, it is generally possible to use another cam having any shape such as a polygonal cam. In that case, the angular locations of the cylinders are defined $n\theta/2$ as described above based on the relationship between the angular locations of the cam protrusions if the cylinders are a pair of cylinders.

For example, a fuel pump 96 in a twentieth embodiment of the present invention has an elliptic cam 97 whose shape is close to a rhombus. The elliptic cam 97 has a pair of protrusions 97*a* and 97*b* having 180 degree phase difference. Therefore, n is equal to 1, and the plungers 83 and 84" (that is, cylinders, too) are provided at locations deviated 90 degrees ($1\times180°/2=90°$) each other.

In the embodiments of the present invention, the plungers of the fuel pump are rotatably driven by the cam. Instead, the plunger may be replace by a piston which is reciprocated by a crank mechanism, an eccentric wheel mechanism or the like.

According to the fuel pump in the embodiments illustrated in the accompanied drawings, a plurality of cylinders and a plurality of plungers are radially located around a polygonal cam having a drive shaft as a radial center to form a multi-cylinder pump having a star shape as a whole, and the discharge pulsations are canceled each other by defining the relative angular locations of the plural cylinders.

Instead, it is possible to place a plurality of cylinders parallel to the drive shaft on a surface of a hypothetical cylinder having a central axis aligned with the drive shaft, and to reciprocate the plungers in its axial direction by using a common face cam having a wave-shaped edge in the axial direction. In this case a plurality of cylinders are located, similarly to the above star-shaped locations, such that they have certain relationships regarding the angular locations with respect to the drive shaft.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A method of designing a fuel supply system for an internal combustion engine including a fuel pump for pressurizing fuel, a high pressure fuel pipe for delivering the pressurized fuel to a plurality of injectors, and at least one delivery pipe installed in the high pressure fuel pipe for distributing the pressurized fuel to the injectors, for reducing pressure pulsation of the fuel in the high pressure fuel pipe, said designing method comprising the steps of:

determining a target frequency, for preventing a resonance among harmonics of the pressure pulsation in the high pressure fuel pipe, from the largest number of speed of the fuel pump and an order frequency of the harmonics whose resonance should be prevented;

calculating a resonance frequency corresponding to a predetermined design data of the system;

changing design data of the system such that said calculated resonance frequency becomes greater than said target frequency;

calculating a waveform of the pressure pulsation of the fuel in the high pressure pipe by a numerical analysis;

determining said order frequency of said harmonics, whose resonance should be prevented, from a peak of an amplitude of said calculated waveform of the pressure pulsation;

calculating a magnitude of a pulsation pressure from a height of said amplitude; and changing design data of the system such that said pulsation pressure becomes less than a predetermined target value.

2. A method of designing a fuel supply system as in claim 1, wherein said resonance frequency is calculated by an impedance method.

3. A designing method of a fuel supply system as in claim 1, wherein an inner diameter of a connecting pipe for connecting said delivery pipe is increased when said design data of said system is changed such that said calculated resonance frequency becomes greater than said target frequency.

4. A fuel supply system for an internal combustion engine having a plurality of cylinders which are divided into a pair of banks, comprising:

a fuel pump for pressurizing fuel;

a plurality of injectors for directly injecting said pressurized fuel to said cylinders respectively;

a high pressure fuel pipe for introducing said pressurized fuel to the injectors;

a pair of delivery pipes, formed as a part of said high pressure fuel pipe, corresponding to the pair of banks for distributing said pressurized fuel to said injectors; and a connecting pipe, formed as a part of said high pressure fuel pipe, for connecting said pair of delivery pipes, wherein:

said connecting pipe includes an enlarged volume portion whose inner diameter is greater than an inner diameter of said connecting pipe, and said enlarged volume portion is located at a position other than connecting portions of said pair of delivery pipes and said connecting pipe.

5. A fuel supply system for an internal combustion engine having a plurality of cylinders which are divided into a pair of banks, comprising:

a fuel pump for pressurizing fuel;

a plurality of injectors for directly injecting said pressurized fuel to said cylinders respectively;

a high pressure fuel pipe for introducing said pressurized fuel to the injectors;

a pair of delivery pipes, formed as a part of said high pressure fuel pipe, corresponding to the pair of banks for distributing said pressurized fuel to said injectors; and a connecting pipe, formed as a part of said high pressure fuel pipe, for connecting said pair of delivery pipes, wherein at least a part of said connecting pipe is provided by a flexible pipe alone, the pipe being made of flexible material.

6. A fuel supply system for an internal combustion engine having a plurality of cylinders, comprising:

a fuel pump for pressurizing fuel;

a plurality of injectors for directly injecting said pressurized fuel to said cylinders respectively;

a high pressure fuel pipe for introducing said pressurized fuel to the injectors;

a pair of delivery pipes, formed as a part of said high pressure fuel pipe, for dividing said injectors into a pair of injector groups and for distributing said pressurized fuel to each of the pair of injector groups; and a connecting pipe, formed as a part of said high pressure fuel pipe, for connecting the pair of delivery pipes to each other, wherein:

said connecting pipe has a diameter larger than a diameter of said delivery pipe, and said connecting pipe is unified with said delivery pipes.

7. A fuel supply system for an internal combustion engine having a plurality of cylinders which are divided into a pair of banks, comprising:

a fuel pump for pressurizing fuel;

a plurality of injectors for directly injecting said pressurized fuel to said cylinders respectively;

a high pressure fuel pipe for introducing said pressurized fuel to the injectors;

a pair of delivery pipes, formed as a part of said high pressure fuel pipe, corresponding to the pair of banks for distributing said pressurized fuel to said injectors; and a connecting pipe, formed as a part of said high pressure fuel pipe, for connecting said pair of delivery pipes to each other, wherein:

said connecting pipe has a diameter larger than respective diameters of said delivery pipes, and said connecting pipe is unified with said delivery pipes.

8. A fuel supply system as in claim 6, wherein a part of said connecting pipe is made of a flexible material.

9. A fuel supply system as in claim 7, wherein a part of said connecting pipe is made of a flexible material.

10. A fuel supply system for an internal combustion engine having a plurality of cylinders, comprising:

a fuel pump for pressurizing fuel;

a plurality of injectors for directly injecting said pressurized fuel to said cylinders respectively;

a plurality of delivery pipes, formed as part of said high pressure fuel pipe, for distributing said pressurized fuel to said injectors; and a connecting pipe, formed as a part of said high pressure fuel pipe, to be connected to said delivery pipes, wherein:

at least one pair of said delivery pipes adjacent each other are connected to via a flexible member on their substantially entire surfaces opposing each other, said connecting pipe connects the pair of said delivery pipes to each other, said connecting pipe has a diameter larger than respective diameters of said delivery pipes, and said connecting pipe is unified with said delivery pipes.

11. A fuel supply system as in claim 5, wherein said pressurized fuel passes through said connecting pipe alone from one of said delivery pipes to the other one of said delivery pipes.

12. A fuel supply system as in claim 11, wherein said connecting pipe and said pair of delivery pipes are connected in series.

13. A fuel supply system for an internal combustion engine having a plurality of cylinders which are divided into a pair of banks, the system comprising:

a fuel pump for pressurizing fuel;

a plurality of injectors for directly injecting the pressurized fuel to the cylinders respectively; and a high pressure fuel pipe for introducing the pressurized fuel to the injectors, wherein the high pressure fuel pipe comprises a first delivery pipe for distributing the pressurized fuel to a first group of the injectors corresponding to the first bank of the engine;

a second delivery pipe for distributing the pressurized fuel to a second group of the injectors corresponding to the second bank of the engine; and a connecting pipe which alone connects the first and second delivery pipes and through which the pressurized fuel passes from the first delivery pipe to the second delivery pipe, and at least a pipe-shaped part of the connecting pipe being made of flexible material.

14. A fuel supply system as in claim 13, wherein the pipe-shaped part of the connecting pipe is made of a flexible material only.

* * * * *